US010173813B2

(12) United States Patent
Ma et al.

(10) Patent No.: US 10,173,813 B2
(45) Date of Patent: Jan. 8, 2019

(54) FLEXIBLE CONTAINER WITH POP-UP SPOUT

(71) Applicant: Dow Global Technologies LLC, Midland, MI (US)

(72) Inventors: Liangkai Ma, Midland, MI (US); Jorge Caminero Gomes, Sao Paulo (BR); Scott R. Kaleyta, Saginaw, MI (US); Daniel Ramirez, Midland, MI (US); Ronald K. Jenkins, Midland, MI (US); Kevin L. Church, Midland, MI (US); Jeffrey D. Zawisza, Midland, MI (US); Sam L. Crabtree, Midland, MI (US); Keith L. Kauffmann, Ypsilanti, MI (US); Peter J. Schulz, Midland, MI (US); John F. Kohn, Freeland, MI (US); Chad V. Schuette, Freeland, MI (US)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 15/280,447

(22) Filed: Sep. 29, 2016

(65) Prior Publication Data

US 2018/0086515 A1 Mar. 29, 2018

(51) Int. Cl.
*B65D 47/06* (2006.01)
*B65D 33/08* (2006.01)
(Continued)

(52) U.S. Cl.
CPC ..... *B65D 47/063* (2013.01); *B65D 25/44* (2013.01); *B65D 33/08* (2013.01); *B65D 53/08* (2013.01);
(Continued)

(58) Field of Classification Search
CPC ..... B65D 33/08; B65D 53/08; B65D 25/46; B65D 47/065; B65D 75/008;
(Continued)

(56) References Cited

U.S. PATENT DOCUMENTS 1,229,085 A 6/1917 Insko
1,555,176 A 9/1925 Allen
(Continued)

FOREIGN PATENT DOCUMENTS

CN 2511621 Y 9/2002
CN 2594172 Y 12/2003
(Continued)

OTHER PUBLICATIONS

Potemkin et al., Physical Review E, vol. 57, No. 6, Jun. 1998, pp. 6902-6912.
Dobrynin, J. Chem. Phys. 107(21), Dec. 1, 1997, pp. 9234-9238.

*Primary Examiner* — Patrick M Buechner
*Assistant Examiner* — Robert Nichols, II
(74) *Attorney, Agent, or Firm* — Husch Blackwell LLP

(57) ABSTRACT

The present disclosure provides a flexible container. In an embodiment, the flexible container includes a first multilayer film and a second multilayer film. Each multilayer film comprises an inner seal layer. The multilayer films are arranged such that the seal layers oppose each other and the second multilayer film is superimposed on the first multilayer film. The multilayer films are sealed along a common peripheral edge. The flexible container includes an orifice in one of the multilayer films, and a pop-up spout extends through the orifice. The pop-up spout has a flange sealed to the multilayer film around the orifice. The pop-up spout comprises an ethylene/α-olefin multi-block copolymer.

20 Claims, 7 Drawing Sheets

(51) Int. Cl.

| | |
|---|---|
| ***B65D 53/08*** | (2006.01) |
| ***B65D 75/00*** | (2006.01) |
| ***B65D 75/58*** | (2006.01) |
| ***B65D 25/44*** | (2006.01) |
| ***B65D 75/56*** | (2006.01) |

(52) U.S. Cl.
CPC ..... *B65D 75/008* (2013.01); *B65D 75/566* (2013.01); *B65D 75/5877* (2013.01)

(58) Field of Classification Search
CPC ..... B65D 47/063; B65D 75/5877; B65D 75/566; B65D 25/44
USPC ..... 222/494, 106, 107, 92, 529, 527
See application file for complete search history.

(56) References Cited

U.S. PATENT DOCUMENTS 1,804,627 A * 5/1931 Lukenbill ..... B65D 47/063 215/271
2,533,305 A 12/1950 Wells
2,565,699 A 8/1951 Rieke
2,695,121 A 11/1954 Daniels
2,773,632 A 12/1956 Dobbins
2,774,523 A 12/1956 Rieke
2,895,654 A 7/1959 Rieke
3,042,271 A 7/1962 Winstead
3,128,016 A 4/1964 Ferri, Jr.
3,264,827 A 8/1966 Siptrott
3,552,607 A 1/1971 Edwards
3,615,965 A 10/1971 Smith et al.
3,658,218 A 4/1972 Krautkramer
3,690,522 A 9/1972 Chlystun
3,923,211 A 12/1975 Spreenfred
4,073,413 A * 2/1978 Tabler ..... B65D 47/063 222/529
4,196,030 A 4/1980 Ausnit
4,219,137 A 8/1980 Hutchens
4,236,629 A 12/1980 Dwinell
4,241,855 A 12/1980 Yoshioka
4,252,256 A 2/1981 Walsh
4,256,154 A 3/1981 Black
4,295,583 A 10/1981 Schurr
4,403,709 A * 9/1983 Meins ..... B65D 25/42 220/229
4,422,563 A 12/1983 Babiol
4,446,994 A 5/1984 Smith
4,492,324 A 1/1985 Weber
4,555,048 A 11/1985 Hamman et al.
4,560,081 A * 12/1985 Adams ..... B65D 47/063 220/260
4,568,006 A 2/1986 Mueller et al.
4,600,125 A 7/1986 Maynard
4,602,728 A 7/1986 Ha
4,618,078 A 10/1986 Hamman et al.
4,629,098 A 12/1986 Eger
4,684,032 A 8/1987 Tsay
4,817,824 A 4/1989 Lafleur et al.
4,907,724 A 3/1990 Wing, Jr. et al.
4,921,147 A 5/1990 Poirier
4,955,493 A 9/1990 Touzani
4,971,226 A 11/1990 Donoghue
5,104,606 A 4/1992 Donoghue
5,133,481 A 7/1992 Mayfield
5,195,661 A 3/1993 Light
5,314,088 A 5/1994 Heuberger et al.
5,649,643 A 7/1997 Ridgeway
5,667,101 A 9/1997 Barash et al.
5,783,638 A 7/1998 Lai et al.
5,918,776 A 7/1999 Atkinson
5,934,522 A 8/1999 Canela et al.
5,961,009 A 10/1999 Rekers
6,047,866 A 4/2000 Brown
6,237,817 B1 5/2001 Son
6,293,436 B2 9/2001 Faughnder et al.
6,363,905 B1 4/2002 Davis
6,695,179 B2 2/2004 Mandile
6,840,164 B2 1/2005 Eastman
7,033,535 B1 4/2006 Limanjaya
7,478,738 B2 1/2009 Hood et al.
7,608,668 B2 10/2009 LiPiShan et al.
7,614,530 B2 11/2009 Baughman et al.
7,624,899 B1 12/2009 Barksdale
7,858,706 B2 12/2010 Arriola et al.
7,893,166 B2 2/2011 Shan et al.
7,947,793 B2 5/2011 Marchand et al.
7,980,431 B1 7/2011 Barksdale
8,453,889 B2 6/2013 Park
8,598,277 B2 * 12/2013 Pellegatti ..... C08J 5/18 525/191
8,814,004 B2 8/2014 Letica et al.
9,056,699 B2 6/2015 Crosby et al.
9,108,371 B2 8/2015 Stegeman et al.
9,108,771 B2 8/2015 Sturk
2002/0148857 A1 * 10/2002 Savage ..... B65D 75/5877 222/107
2004/0188474 A1 9/2004 Johnston et al.
2005/0194398 A1 9/2005 Leyendecket et al.
2006/0049550 A1 3/2006 Lin
2006/0199905 A1 9/2006 Hughes et al.
2006/0199930 A1 * 9/2006 Li Pi Shan ..... C08F 212/08 526/346
2006/0286324 A1 12/2006 Helmenstein
2007/0056996 A1 * 3/2007 Zijing ..... B65D 17/4012 222/530
2007/0155900 A1 * 7/2007 Chang ..... A61F 13/4902 525/88
2007/0284398 A1 12/2007 Baughman et al.
2009/0139883 A1 6/2009 Py et al.
2010/0038386 A1 * 2/2010 Pritchard ..... B65D 33/065 222/522
2010/0203300 A1 * 8/2010 Coulter ..... B41M 5/267 428/195.1
2011/0056965 A1 3/2011 Peer et al.
2012/0085794 A1 4/2012 Selina et al.
2014/0231468 A1 8/2014 Wade et al.
2014/0246435 A1 9/2014 Py et al.

FOREIGN PATENT DOCUMENTS

| | | | |
|---|---|---|---|
| CN | 203781006 | U | 8/2014 |
| CN | 102849322 | B | 10/2014 |
| EP | 0093493 | A1 | 11/1983 |
| EP | 0082757 | B1 | 8/1986 |
| GB | 468902 | | 7/1937 |
| GB | 753468 | A | 7/1956 |
| GB | 2102398 | B | 10/1985 |
| WO | 2008128414 | A1 | 10/2008 |
| WO | 2012135080 | A2 | 10/2012 |

* cited by examiner

FLEXIBLE CONTAINER WITH POP-UP SPOUT

BACKGROUND

The present disclosure is directed to fitments for flexible containers.

Known are flexible pouches with fitments. A fitment is a rigid pour spout for delivery of flowable material from a flexible container or a flexible pouch. Such pouches are often referred to as "pour-pouches."

Conventional pour pouches typically include a fitment with a canoe-shaped base that is sandwiched between opposing flexible films and heat sealed along the peripheral edge of the pouch. As such, the location of the fitment is restricted—limited to the edge of the pour pouch. The limited peripheral location of the fitment also limits the pour geometry of the pour pouch. Moreover, sealing the fitment to the pouch edge is problematic because it requires precise alignment between the fitment base and the flexible films in order to reduce the risk of poor seal. Consequently, production procedures without the requisite degree of precision suffer from high seal failure rates.

The art recognizes the need for flexible pouches that are not limited to fitment location along the peripheral edge of the package and also recognizes the need to reduce the incidence of leakage during flexible pouch production. The art further recognizes the need for flexible pouches having alternate pour geometries other than those provided by peripheral edge fitments.

SUMMARY

The present disclosure provides a flexible container with a surface mounted pop-up spout. The pop-up spout location is not limited to the peripheral edge of the flexible containers. The pop-up spout has a telescopic spout design which provides improved flow direction and volume control to the flexible container.

The present disclosure provides a flexible container. In an embodiment, the flexible container includes a first multilayer film and a second multilayer film. Each multilayer film comprises an inner seal layer. The multilayer films are arranged such that the seal layers oppose each other and the second multilayer film is superimposed on the first multilayer film. The multilayer films are sealed along a common peripheral edge. The flexible container includes an orifice in one of the multilayer films, and a pop-up spout extends through (or from) the orifice. The pop-up spout has a flange sealed to the multilayer film around the orifice. The pop-up spout comprises an ethylene/α-olefin multi-block copolymer.

The present disclosure provides another flexible container. In an embodiment, the flexible container includes a front panel and a rear panel. The front panel is superimposed on the rear panel. A first gusset panel and a second gusset panel are located between the front panel and the rear panel. Each panel is composed of a multilayer film and each multilayer film comprises an inner seal layer. The panels are heat sealed along a common peripheral edge. The flexible container includes an orifice in one of panels, and a pop-up spout extends through (or from) the orifice. The pop-up spout has a flange sealed to the inner seal layer of the panel at the orifice. The pop-up spout comprises an ethylene/α-olefin multi-block copolymer.

An advantage of the present disclosure is a flexible container with a pop-up spout that can be utilized with form-fill and seal production equipment.

An advantage of the present disclosure is a flexible container with an injection molded pop-up spout having a flexible valve made in the same injection molding operation and made of the same material as the pop-up spout.

An advantage of the present disclosure is a flexible container with a pop-up spout that provides improved flow control for pouring of flowable material, such as liquids.

An advantage of the present disclosure is an ethylene/α-olefin multi-block copolymer pop-up spout offering comfort for the user in situations where the spout is taken directly to the person's mouth for consuming a comestible contained in the flexible container.

An advantage of the present disclosure is a flexible container with a flexible and elastic pop-up spout that can serve as a nipple or a straw for the suction removal of content from the flexible container.

An advantage of the present disclosure is a flexible container with a pop-up spout that is protected by a pressure-sensitive-adhesive (PSA) film that prevents premature extension of the spout. The PSA also provides aseptic conditions for the pop-up spout prior use and serves as a tamper evident proof for the consumer.

DEFINITIONS

Figure 1:
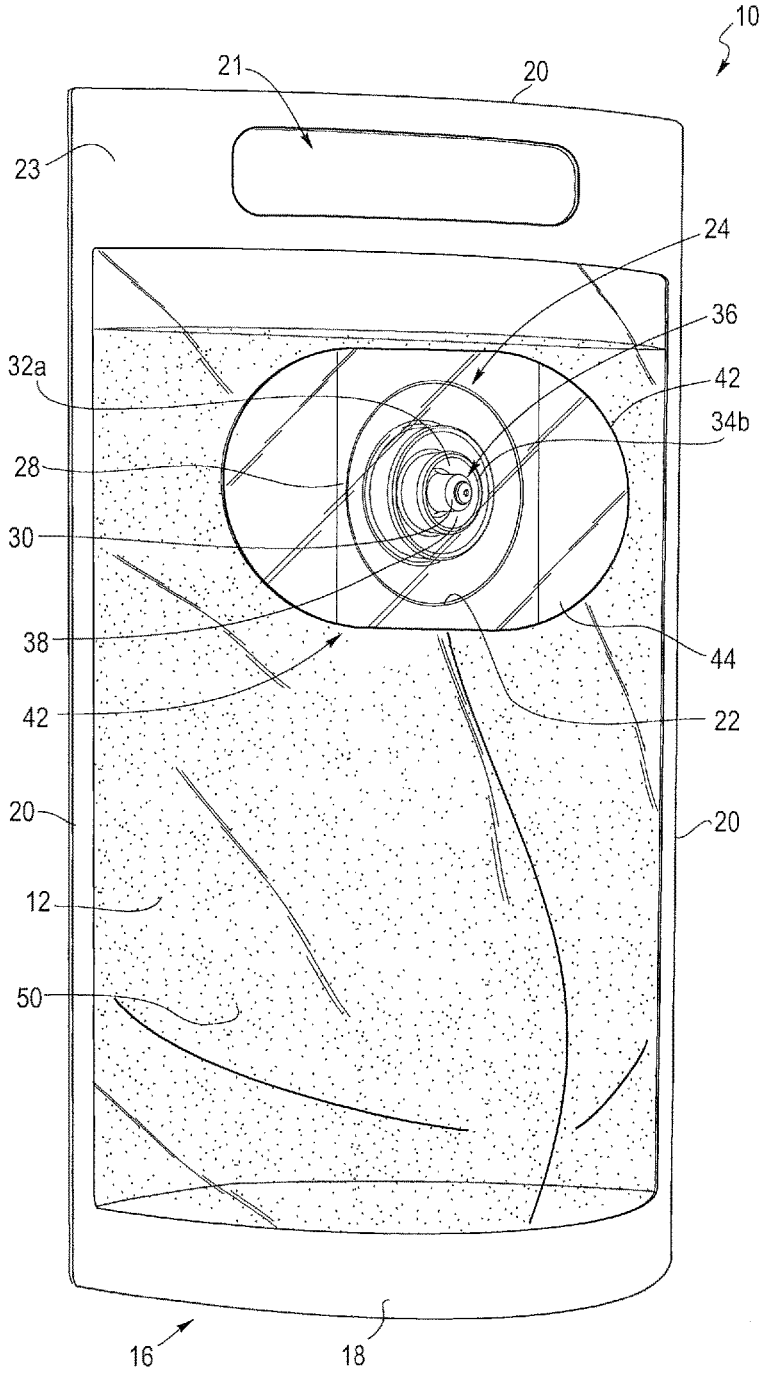
FIG. 1 is a perspective view of a flexible container with a pop-up spout in accordance with an embodiment of the present disclosure.

All references to the Periodic Table of the Elements herein shall refer to the Periodic Table of the Elements, published and copyrighted by CRC Press, Inc., 2003. Also, any references to a Group or Groups shall be to the Groups or Groups reflected in this Periodic Table of the Elements using the IUPAC system for numbering groups. Unless stated to the contrary, implicit from the context, or customary in the art, all parts and percents are based on weight. For purposes of United States patent practice, the contents of any patent, patent application, or publication referenced herein are hereby incorporated by reference in their entirety (or the equivalent US version thereof is so incorporated by reference), especially with respect to the disclosure of synthetic techniques, definitions (to the extent not inconsistent with any definitions provided herein) and general knowledge in the art.

The numerical ranges disclosed herein include all values from, and including, the lower value and the upper value. For ranges containing explicit values (e.g., 1 or 2, or 3 to 5, or 6, or 7) any subrange between any two explicit values is included (e.g., 1 to 2; 2 to 6; 5 to 7; 3 to 7; 5 to 6; etc.).

Unless stated to the contrary, implicit from the context, or customary in the art, all parts and percents are based on weight, and all test methods are current as of the filing date of this disclosure.

The term "composition," as used herein, refers to a mixture of materials which comprise the composition, as well as reaction products and decomposition products formed from the materials of the composition.

The terms "comprising," "including," "having," and their derivatives, are not intended to exclude the presence of any additional component, step or procedure, whether or not the same is specifically disclosed. In order to avoid any doubt, all compositions claimed through use of the term "comprising" may include any additional additive, adjuvant, or compound, whether polymeric or otherwise, unless stated to the contrary. In contrast, the term, "consisting essentially of" excludes from the scope of any succeeding recitation any other component, step or procedure, excepting those that are not essential to operability. The term "consisting of" excludes any component, step or procedure not specifically delineated or listed.

Density is measured in accordance with ASTM D 792.

Elastic recovery is measured as follows. Stress-strain behavior in uniaxial tension is measured using an Instron™ universal testing machine at 300% $min^{-1}$ deformation rate at 21° C. The 300% elastic recovery is determined from a loading followed by unloading cycle to 300% strain, using ASTM D 1708 microtensile specimens. Percent recovery for all experiments is calculated after the unloading cycle using the strain at which the load returned to the base line. The percent recovery is defined as:

$$\% \text{ Recovery}=100*(Ef-Es)/Ef$$

where Ef is the strain taken for cyclic loading and Es is the strain where the load returns to the baseline after the unloading cycle.

An "ethylene-based polymer," as used herein is a polymer that contains more than 50 mole percent polymerized ethylene monomer (based on the total amount of polymerizable monomers) and, optionally, may contain at least one comonomer.

Melt flow rate (MFR) is measured in accordance with ASTM D 1238, Condition 280° C./2.16 kg (g/10 minutes).

Melt index (MI) is measured in accordance with ASTM D 1238, Condition 190° C./2.16 kg (g/10 minutes).

Shore A hardness is measured in accordance with ASTM D 2240.

Tm or "melting point" as used herein (also referred to as a melting peak in reference to the shape of the plotted DSC curve) is typically measured by the DSC (Differential Scanning calorimetry) technique for measuring the melting points or peaks of polyolefins as described in U.S. Pat. No. 5,783,638. It should be noted that many blends comprising two or more polyolefins will have more than one melting point or peak, many individual polyolefins will comprise only one melting point or peak.

An "olefin-based polymer," as used herein is a polymer that contains more than 50 mole percent polymerized olefin monomer (based on total amount of polymerizable monomers), and optionally, may contain at least one comonomer. Nonlimiting examples of olefin-based polymer include ethylene-based polymer and propylene-based polymer.

A "polymer" is a compound prepared by polymerizing monomers, whether of the same or a different type, that in polymerized form provide the multiple and/or repeating "units" or "mer units" that make up a polymer. The generic term polymer thus embraces the term homopolymer, usually employed to refer to polymers prepared from only one type of monomer, and the term copolymer, usually employed to refer to polymers prepared from at least two types of monomers. It also embraces all forms of copolymer, e.g., random, block, etc. The terms "ethylene/α-olefin polymer" and "propylene/α-olefin polymer" are indicative of copolymer as described above prepared from polymerizing ethylene or propylene respectively and one or more additional, polymerizable α-olefin monomer. It is noted that although a polymer is often referred to as being "made of" one or more specified monomers, "based on" a specified monomer or monomer type, "containing" a specified monomer content, or the like, in this context the term "monomer" is understood to be referring to the polymerized remnant of the specified monomer and not to the unpolymerized species. In general, polymers herein are referred to has being based on "units" that are the polymerized form of a corresponding monomer.

A "propylene-based polymer" is a polymer that contains more than 50 mole percent polymerized propylene monomer (based on the total amount of polymerizable monomers) and, optionally, may contain at least one comonomer.

DETAILED DESCRIPTION

The present disclosure provides a flexible container. In an embodiment, the flexible container includes a first multilayer film and a second multilayer film. Each multilayer film includes an inner seal layer. The multilayer films are arranged such that seal layers oppose each other and the second multilayer film is superimposed on the first multilayer film. The multilayer films are sealed along a common peripheral edge. An orifice is present in one of the multilayer films. A pop-up spout extends from the orifice. The pop-up spout has a flange sealed to the multilayer film around the orifice. The pop-up spout is composed of an ethylene/α-olefin multi-block copolymer.

1. Multilayer Films

The present flexible container includes a first multilayer film and a second multilayer film. It is understood the flexible container can include two, three, four, five, or six or more multilayer films. Each multilayer film is flexible and has at least two, or at least three layers. The flexible multilayer film is resilient, flexible, deformable, and pliable. The structure and composition for each multilayer film may be the same or different. For example, each of two opposing multilayer films can be made from a separate web, each web having a unique structure and/or unique composition, finish, or print. Alternatively, each multilayer film can be the same structure and the same composition.

The flexible multilayer film is composed of a polymeric material. Nonlimiting examples of suitable polymeric material include olefin-based polymer; propylene-based polymer; ethylene-based polymer; polyamide (such as nylon), ethylene-acrylic acid or ethylene-methacrylic acid and their ionomers with zinc, sodium, lithium, potassium, or magnesium salts; ethylene vinyl acetate (EVA) copolymers; and blends thereof. The flexible multilayer film can be either printable or compatible to receive a pressure sensitive label or other type of label for displaying of indicia on the flexible container.

In an embodiment, a flexible multilayer film is provided and includes at least three layers: (i) an outermost layer, (ii) one or more core layers, and (iii) an innermost seal layer. The outermost layer (i) and the innermost seal layer (iii) are surface layers with the one or more core layers (ii) sandwiched between the surface layers. The outermost layer may include (a-i) a HDPE, (b-ii) a propylene-based polymer, or combinations of (a-i) and (b-ii), alone, or with other olefin-based polymers such as low density polyethylene (LDPE). Nonlimiting examples of suitable propylene-based polymers include propylene homopolymer, random propylene/α-olefin copolymer (majority amount propylene with less than 10 weight percent ethylene comonomer), and propylene impact copolymer (heterophasic propylene/ethylene copolymer rubber phase dispersed in a matrix phase).

With the one or more core layers (ii), the number of total layers in the present multilayer film can be from three layers (one core layer), or four layers (two core layers), or five layers (three core layers, or six layers (four core layers), or seven layers (five core layers) to eight layers (six core layers), or nine layers (seven core layers), or ten layers (eight core layers), or eleven layers (nine core layers), or more.

Each multilayer film has a thickness from 75 microns, or 100 microns, or 125 microns, or 150 microns to 200 microns, or 250 microns or 300 microns or 350 microns, or 400 microns.

In an embodiment, each multilayer film is a flexible multilayer film having the same structure and the same composition.

The flexible multilayer film may be (i) a coextruded multilayer structure or (ii) a laminate, or (iii) a combination of (i) and (ii). In an embodiment, the flexible multilayer film has at least three layers: a seal layer, an outer layer, and a tie layer between. The tie layer adjoins the seal layer to the outer layer. The flexible multilayer film may include one or more optional inner layers disposed between the seal layer and the outer layer.

In an embodiment, the flexible multilayer film is a coextruded film having at least two, or three, or four, or five, or six, or seven to eight, or nine, or 10, or 11, or more layers. Some methods, for example, used to construct films are by cast co-extrusion or blown co-extrusion methods, adhesive lamination, extrusion lamination, thermal lamination, and coatings such as vapor deposition. Combinations of these methods are also possible. Film layers can comprise, in addition to the polymeric materials, additives such as stabilizers, slip additives, antiblocking additives, process aids, clarifiers, nucleators, pigments or colorants, fillers and reinforcing agents, and the like as commonly used in the packaging industry. It is particularly useful to choose additives and polymeric materials that have suitable organoleptic and/or optical properties.

In an embodiment, the outermost layer includes a high density polyethylene (HDPE). In a further embodiment, the HDPE is a substantially linear multi-component ethylene-based copolymer (EPE) such as ELITE™ resin provided by The Dow Chemical Company.

In an embodiment, each core layer includes one or more linear or substantially linear ethylene-based polymers or block copolymers having a density from 0.908 g/cc, or 0.912 g/cc, or 0.92 g/cc, or 0.921 g/cc to 0.925 g/cc, or less than 0.93 g/cc. In an embodiment, each of the one or more core layers includes one or more ethylene/$C_3$-$C_8$ α-olefin copolymers selected from linear low density polyethylene (LLDPE), ultralow density polyethylene (ULDPE), very low density polyethylene (VLDPE), multi-component ethylene-based polymer ("EPE"), olefin block copolymer (OBC), plastomers/elastomers, and single-site catalyzed linear low density polyethylenes (m-LLDPE).

In an embodiment, the seal layer includes one or more ethylene-based polymers having a density from 0.86 g/cc, or 0.87 g/cc, or 0.875 g/cc, or 0.88 g/cc, or 0.89 g/cc to 0.90 g/cc, or 0.902 g/cc, or 0.91 g/cc, or 0.92 g/cc. In a further embodiment, the seal layer includes one or more ethylene/$C_3$-$C_8$ α-olefin copolymers selected from EPE, plastomers/elastomers, or m-LLDPE.

In an embodiment, the flexible multilayer film is a coextruded film, the seal layer is composed of an ethylene-based polymer, such as a linear or a substantially linear polymer, or a single-site catalyzed linear or substantially linear polymer of ethylene and an alpha-olefin monomer such as 1-butene, 1-hexene or 1-octene, having a Tm from 55° C. to 115° C. and a density from 0.865 to 0.925 g/cm$^3$, or from 0.875 to 0.910 g/cm$^3$, or from 0.888 to 0.900 g/cm$^3$ and the outer layer is composed of a polyamide having a Tm from 170° C. to 270° C.

In an embodiment, the flexible multilayer film is a coextruded film and/or a laminated film having at least five layers, the coextruded film having a seal layer composed of an ethylene-based polymer, such as a linear or substantially linear polymer, or a single-site catalyzed linear or substantially linear polymer of ethylene and an alpha-olefin comonomer such as 1-butene, 1-hexene or 1-octene, the ethylene-based polymer having a Tm from 55° C. to 115° C. and a density from 0.865 to 0.925 g/cm$^3$, or from 0.875 to 0.910 g/cm$^3$, or from 0.888 to 0.900 g/cm$^3$ and an outermost layer composed of a material selected from HDPE, EPE, LLDPE, OPET (biaxially oriented polyethylene terephthalate), OPP (oriented polypropylene), BOPP (biaxially oriented polypropylene), polyamide, and combinations thereof.

In an embodiment, the flexible multilayer film is a coextruded and/or laminated film having at least seven layers. The seal layer is composed of an ethylene-based polymer, such as a linear or substantially linear polymer, or a single-site catalyzed linear or substantially linear polymer of ethylene and an alpha-olefin comonomer such as 1-butene, 1-hexene or 1-octene, the ethylene-based polymer having a Tm from 55° C. to 115° C. and density from 0.865 to 0.925 g/cm$^3$, or from 0.875 to 0.910 g/cm$^3$, or from 0.888 to 0.900 g/cm$^3$. The outer layer is composed of a material selected from HDPE, EPE, LLDPE, OPET, OPP, BOPP, polyamide, and combinations thereof.

In an embodiment, the flexible multilayer film is a coextruded (or laminated) film of three or more layers where all layers consist of ethylene-based polymers. In a further embodiment, the flexible multilayer film is a coextruded (or laminated) film of three or more layers where each layer consists of ethylene-based polymers and (1) the seal layer is composed of a linear or substantially linear ethylene-based polymer, or a single-site catalyzed linear or substantially linear polymer of ethylene and an alpha-olefin comonomer such as 1-butene, 1-hexene or 1-octene, the ethylene-based polymer having a Tm from 55° C. to 115° C. and density from 0.865 to 0.925 g/cm$^3$, or from 0.875 to 0.910 g/cm$^3$, or from 0.888 to 0.900 g/cm$^3$ and (2) the outer layer includes one or more ethylene-based polymers selected from HDPE, EPE, LLDPE or m-LLDPE and (3) each of the one or more core layers includes one or more ethylene/$C_3$-$C_8$ α-olefin copolymers selected from LDPE, LLDPE, ULDPE, VLDPE, EPE, olefin block copolymer (OBC), plastomers/elastomers, and m-LLDPE.

In an embodiment, the flexible multilayer film is a coextruded and/or laminated five layer, or a coextruded (or laminated) seven layer film having at least one layer containing OPET or OPP.

In an embodiment, the flexible multilayer film is a coextruded (or laminated) five layer, or a coextruded (or laminated) seven layer film having at least one layer containing polyamide.

In an embodiment, the flexible multilayer film is a seven-layer coextruded (or laminated) film with a seal layer composed of an ethylene-based polymer, or a linear or substantially linear polymer, or a single-site catalyzed linear or substantially linear polymer of ethylene and an alpha-olefin monomer such as 1-butene, 1-hexene or 1-octene, having a Tm from 90° C. to 106° C. The outer layer is a polyamide having a Tm from 170° C. to 270° C. The film has an inner layer (first inner layer) composed of a second ethylene-based polymer, different than the ethylene-based polymer in the seal layer. The film has an inner layer (second inner layer) composed of a polyamide the same or different to the polyamide in the outer layer. The seven layer film has a thickness from 100 micrometers to 250 micrometers.

In an embodiment, a flexible container 10 is provided as shown in FIGS. 1-6. The flexible container 10 includes a first multilayer film 12 (front film 12) and a second multilayer film 14 (rear film 14). The multilayer films 12, 14 can be any flexible multilayer film as previously disclosed herein. The rear film 14 is superimposed on the front film 12. Each film 12, 14 has a respective seal layer containing an olefin-based polymer. The seal layer of front film 12 opposes the seal layer of the rear film 14.

The flexible container 10 also includes a gusset panel 16. The gusset panel 16 is formed from front film 12 and/or rear film 14. The gusset panel 16 includes a gusset rim 18. The gusset panel 16 provides (1) the structural integrity to support the flexible container and its contents without leakage, and (2) the stability for the flexible container to stand upright (gusset rim on a support surface, such as a horizontal surface, or a substantially horizontal surface), without tipping over. In this sense, the flexible container 10 is a "stand up pouch" or "SUP."

The front film 12 and the rear film 14 are sealed around a common peripheral edge 20. In an embodiment, the front film 12, the rear film 14, and the gusset rim 18 are heat sealed to each other along the common peripheral edge 20. The term "heat seal process" or "heat sealing," and like terms, as used herein, is the act of placing two or more films of polymeric material between opposing heat seal bars, the heat seal bars moved toward each other, sandwiching the films, to apply heat and pressure to the films such that opposing interior surfaces (seal layers) of the films contact, melt, and form a heat seal, or weld, to attach the films to each other. Heat sealing includes suitable structure and mechanism to move the seal bars toward and away from each other in order to perform the heat sealing procedure.

In an embodiment, a handle 21 is present in a top heat seal 23 of the flexible pouch 10. In a further embodiment, the handle 21 is a cut-out handle formed by side cuts and a bottom cut in the top seal 23, with flaps of the films attached along a top portion of the cut-out area. The flaps are folded to extend outward and thereby provide comfort to a person's hand with carrying, or otherwise handling, the flexible container 10 by way of the handle 21.

An orifice 22 is present in one of the multilayer films. The orifice 22 is sized, or otherwise configured, so that a portion of a pop-up spout 24 extends through the orifice 22 and the diameter of the flange 28 is too large to pass through the orifice 22. In this way, the flange 28 is located in the container interior and the rest of the spout extends outward from the multilayer film. Alternatively, the flange 28 is adhered to the outermost layer of the multilayer film and the pop-up spout 24 extends outward from the orifice 22. Flange adhesion to the outer surface of the multilayer film occurs by way of heat seal, adhesive seal, and combinations thereof.

2. Pop-Up Spout

The pop-up spout 24 is composed of an ethylene/α-olefin multi-block copolymer. The pop-up spout 24 is hollow and has a channel 26 extending therethrough. The pop-up spout 24 includes a flange 28 at a proximate end and a dispensing outlet 30 (or outlet 30) at a distal end. A plurality of integrally connected foldable panels 32*a*-32*e* are present between the flange 28 and the outlet 30. The foldable panels are integrally connected by way of a plurality of flexible elbows 34*a*, 34*b*, 34*c*, 34*d*, and 34*e*. The flange 28, the outlet 30, foldable panels 32*a*-32*e*, and the flexible elbows 34*a*-34*e* are connected, and each is composed of the same ethylene/α-olefin multi-block copolymer (or the same polymeric blend as will be discussed below). The flexible elbows connect the foldable panels to each other and enable adjoining foldable panels to flex, or hingedly move, with respect to each other. The pop-up spout 24 is an integral component. In other words, the flange 28, the outlet 30, the foldable panels 32*a*-32*e*, and the flexible elbows 34*a*-34*e*, each is a component of the same one-shot molded article, each component composed of the same polymeric material—a single integral article.

In an embodiment, two or more components of the pop-up spout 24 are composed of a different polymeric material. For example, the outlet 30 and/or the flexible valve 36 may be composed of one polymeric material (to form a bite valve) that is more rigid than another polymeric material (such as the ethylene/α-olefin multi-block copolymer/HDPE blend) forming the other components—foldable panels, foldable elbows, flange. By way of another example, the flange 28 may be composed of one polymeric material that promotes heat sealing with the multilayer film, and the other components (foldable panels, foldable elbows, outlet, valve) are formed from another and different polymeric material (such as the ethylene/α-olefin multi-block copolymer/HDPE blend) for enabling the pop-up feature of the spout 24. Such multi-material spouts may be produced by way of a two-shot mold procedure or a multi-shot mold procedure.

In an embodiment, the foldable panels 32*a*-32*e* are concentrically disposed with respect to each other. Although FIGS. 1-6 show pop-up spout 24 with five foldable panels, it is understood that the pop-up spout 24 can have from 2, or 3, or 4, or 5 to 6, or 7, or 8, or 9, or 10, or more foldable panels. The flexible elbows 34*a*-34*e* enable the foldable panels to fold upon themselves in an accordion-like manner whereby the panels fold in an alternating manner, resembling the bellows of an accordion, and as shown in FIG. 2A. Each flexible elbow 34*a*-34*e* is resilient and movable, each flexible elbow having the ability to flex to a retracted state and extend to a partially extended state, or extend to a fully extended state. A restraining member extending across the diameter of the flange 28 is required to maintain the pop-up spout 24 in the retracted state. The pop-up spout has an innate compressive force, or inherent outwardly pushing force, which naturally moves at least one of the flexible elbow(s) to a fully extended state as will be disclosed in detail below.

Individually, each foldable panel is a hollow tube, cylindrical, or substantially cylindrical, in shape. As shown in FIGS. 2A, 3A, and 5A, the diameter of each foldable panel 32*a*-32*e* decreases moving from the proximate end of the flexible spout (i.e., the flange 28) to the spout distal end (i.e., the outlet 30). In other words, the diameter of each panel (cylinder) is smaller than the preceding panel (cylinder), moving from the flange (proximate end) to the outlet (distal end). The foldable panels 32*a*-32*e* provide the vertical rise for the pop-up spout 24.

In an embodiment, the outlet 30 has a radius A, as shown in FIG. 5A. Radius A is less than radius B of foldable panel 32*a*, that is less than radius C of foldable panel 32*b*, that is less than radius D of foldable panel 32*c*, that is less than radius E of foldable panel 32*d*, that is less than radius F of foldable channel 32*e*, that is less than radius G of flange 28. In this way, the foldable panels concentrically nest within each other when in a retracted state X, shown in FIG. 2A. The term "retracted state" (or "retracted state X"), as used herein, is the configuration of the pop-up spout 24 whereby every flexible elbow 34*a*-34*e* is retracted. As shown in FIG. 2A, the outlet 30 is concentrically the innermost panel when in the retracted state X. As shown in FIGS. 2A, 3A, 5A, the outlet 30 has the smallest diameter and the flange 28 has the largest diameter.

In an embodiment, a portion of the pop-up spout 24 extends through the orifice 22. The flange 28 is located in the interior of the flexible container 10 and contacts the seal layer of one of the multilayer films, in this case the front film 12. The flange 28 is attached along the circumferential edge area of the front film 12 that defines the orifice. Attachment between the film seal layer and the flange 28 occurs by way of (i) heat seal, (ii) adhesive seal, and (iii) a combination of (i) and (ii).

Alternatively, the flange 28 may be sealed to the outermost layer of the front film 12 (or rear film 14). Adhesion between the flange 28 and the outermost layer may be by way of (i) heat seal, (ii) adhesive seal, and (iii) a combination of (i) and (ii).

In an embodiment, the pop-up spout 24 has a wall thickness T, as seen in FIGS. 2A, 3A, and 5A. The components of the pop-up spout—the flange 28, the outlet 30, the foldable panels 32*a*-32*e*, and the flexible elbows 34*a*-34*e*—each has the same, or substantially the same, wall thickness. In a further embodiment, the wall thickness T for each component of the pop-up spout 24 is the same and is from 0.2 mm, or 0.3 mm, or 0.4 mm, or 0.5 mm, or 0.6 mm, or 0.7 mm, or 0.8 mm, or 0.9 mm, or 1.0 mm to 1.2 mm, or 1.5 mm, or 1.7 mm, or 1.9 mm, or 2.0 mm.

3. Ethylene/α-Olefin Multi-Block Copolymer

The pop-up spout 24 is formed from an ethylene/α-olefin multi-block copolymer. The term "ethylene/α-olefin multi-block copolymer" includes ethylene and one or more copolymerizable α-olefin comonomer in polymerized form, characterized by multiple blocks or segments of two or more polymerized monomer units differing in chemical or physical properties. The term "ethylene/α-olefin multi-block copolymer" includes block copolymer with two blocks (di-block) and more than two blocks (multi-block). The terms "interpolymer" and "copolymer" are used interchangeably herein. When referring to amounts of "ethylene" or "comonomer" in the copolymer, it is understood that this means polymerized units thereof. In some embodiments, the ethylene/α-olefin multi-block copolymer can be represented by the following formula:

$$(AB)_n$$

where n is at least 1, preferably an integer greater than 1, such as 2, 3, 4, 5, 10, 15, 20, 30, 40, 50, 60, 70, 80, 90, 100, or higher, "A" represents a hard block or segment and "B" represents a soft block or segment. Preferably, As and Bs are linked, or covalently bonded, in a substantially linear fashion, or in a linear manner, as opposed to a substantially branched or substantially star-shaped fashion. In other embodiments, A blocks and B blocks are randomly distributed along the polymer chain. In other words, the block copolymers usually do not have a structure as follows:

*AAA-AA-BBB-BB*

In still other embodiments, the block copolymers do not usually have a third type of block, which comprises different comonomer(s). In yet other embodiments, each of block A and block B has monomers or comonomers substantially randomly distributed within the block. In other words, neither block A nor block B comprises two or more sub-segments (or sub-blocks) of distinct composition, such as a tip segment, which has a substantially different composition than the rest of the block.

Preferably, ethylene comprises the majority mole fraction of the whole block copolymer, i.e., ethylene comprises at least 50 mole percent of the whole polymer. More preferably ethylene comprises at least 60 mole percent, at least 70 mole percent, or at least 80 mole percent, with the substantial remainder of the whole polymer comprising at least one other comonomer that is preferably an α-olefin having 3 or more carbon atoms. In some embodiments, the ethylene/α-olefin multi-block copolymer may comprise 50 mol % to 90 mol % ethylene, or 60 mol % to 85 mol %, or 65 mol % to 80 mol %. For many ethylene/octene multi-block copolymers, the composition comprises an ethylene content greater than 80 mole percent of the whole polymer and an octene content of from 10 to 15, or from 15 to 20 mole percent of the whole polymer.

The ethylene/α-olefin multi-block copolymer includes various amounts of "hard" segments and "soft" segments. "Hard" segments are blocks of polymerized units in which ethylene is present in an amount greater than 90 weight percent, or 95 weight percent, or greater than 95 weight percent, or greater than 98 weight percent based on the weight of the polymer, up to 100 weight percent. In other words, the comonomer content (content of monomers other than ethylene) in the hard segments is less than 10 weight percent, or 5 weight percent, or less than 5 weight percent, or less than 2 weight percent based on the weight of the polymer, and can be as low as zero. In some embodiments, the hard segments include all, or substantially all, units derived from ethylene. "Soft" segments are blocks of polymerized units in which the comonomer content (content of monomers other than ethylene) is greater than 5 weight percent, or greater than 8 weight percent, greater than 10 weight percent, or greater than 15 weight percent based on the weight of the polymer. In some embodiments, the comonomer content in the soft segments can be greater than 20 weight percent, greater than 25 weight percent, greater than 30 weight percent, greater than 35 weight percent, greater than 40 weight percent, greater than 45 weight percent, greater than 50 weight percent, or greater than 60 weight percent and can be up to 100 weight percent.

The soft segments can be present in an ethylene/α-olefin multi-block copolymer from 1 weight percent to 99 weight percent of the total weight of the ethylene/α-olefin multi-block copolymer, or from 5 weight percent to 95 weight percent, from 10 weight percent to 90 weight percent, from 15 weight percent to 85 weight percent, from 20 weight percent to 80 weight percent, from 25 weight percent to 75 weight percent, from 30 weight percent to 70 weight percent, from 35 weight percent to 65 weight percent, from 40 weight percent to 60 weight percent, or from 45 weight percent to 55 weight percent of the total weight of the ethylene/α-olefin multi-block copolymer. Conversely, the hard segments can be present in similar ranges. The soft segment weight percentage and the hard segment weight percentage can be calculated based on data obtained from DSC or NMR. Such methods and calculations are disclosed in, for example, U.S. Pat. No. 7,608,668, entitled "Ethylene/α-Olefin Block Interpolymers," filed on Mar. 15, 2006, in the name of Colin L. P. Shan, Lonnie Hazlitt, et al. and assigned to Dow Global Technologies Inc., the disclosure of which is incorporated by reference herein in its entirety. In particular, hard segment and soft segment weight percentages and comonomer content may be determined as described in Column 57 to Column 63 of U.S. Pat. No. 7,608,668.

The ethylene/α-olefin multi-block copolymer is a polymer comprising two or more chemically distinct regions or segments (referred to as "blocks") preferably joined (or covalently bonded) in a linear manner, that is, a polymer comprising chemically differentiated units which are joined end-to-end with respect to polymerized ethylenic functionality, rather than in pendent or grafted fashion. In an embodiment, the blocks differ in the amount or type of incorporated comonomer, density, amount of crystallinity, crystallite size attributable to a polymer of such composition, type or degree of tacticity (isotactic or syndiotactic), regio-regularity or regio-irregularity, amount of branching (including long chain branching or hyper-branching), homogeneity or any other chemical or physical property. Compared to block interpolymers of the prior art, including interpolymers produced by sequential monomer addition, fluxional catalysts, or anionic polymerization techniques, the present ethylene/α-olefin multi-block copolymer is characterized by unique distributions of both polymer polydispersity (PDI or Mw/Mn or MWD), polydisperse block length distribution, and/or polydisperse block number distribution, due, in an embodiment, to the effect of the shuttling agent(s) in combination with multiple catalysts used in their preparation.

In an embodiment, the ethylene/α-olefin multi-block copolymer is produced in a continuous process and possesses a polydispersity index (Mw/Mn) from 1.7 to 3.5, or from 1.8 to 3, or from 1.8 to 2.5, or from 1.8 to 2.2. When produced in a batch or semi-batch process, the ethylene/α-olefin multi-block copolymer possesses Mw/Mn from 1.0 to 3.5, or from 1.3 to 3, or from 1.4 to 2.5, or from 1.4 to 2.

In addition, the ethylene/α-olefin multi-block copolymer possesses a PDI (or Mw/Mn) fitting a Schultz-Flory distribution rather than a Poisson distribution. The present ethylene/α-olefin multi-block copolymer has both a polydisperse block distribution as well as a polydisperse distribution of block sizes. This results in the formation of polymer products having improved and distinguishable physical properties. The theoretical benefits of a polydisperse block distribution have been previously modeled and discussed in Potemkin, *Physical Review E* (1998) 57 (6), pp. 6902-6912, and Dobrynin, *J. Chem. Phys.* (1997) 107 (21), pp 9234-9238.

In an embodiment, the present ethylene/α-olefin multi-block copolymer possesses a most probable distribution of block lengths.

In a further embodiment, the ethylene/α-olefin multi-block copolymer of the present disclosure, especially those made in a continuous, solution polymerization reactor, possess a most probable distribution of block lengths. In one embodiment of this disclosure, the ethylene multi-block interpolymers are defined as having:

(A) Mw/Mn from about 1.7 to about 3.5, at least one melting point, Tm, in degrees Celsius, and a density, d, in grams/cubic centimeter, where in the numerical values of Tm and d correspond to the relationship:

$$Tm>-2002.9+4538.5(d)-2422.2(d)^2, \text{ or}$$

(B) Mw/Mn from about 1.7 to about 3.5, and is characterized by a heat of fusion, ΔH in J/g, and a delta quantity, ΔT, in degrees Celsius defined as the temperature difference between the tallest DSC peak and the tallest Crystallization Analysis Fractionation ("CRYSTAF") peak, wherein the numerical values of ΔT and ΔH have the following relationships:

$$\Delta T>-0.1299(\Delta H)+62.81 \text{ for } \Delta H \text{ greater than zero and up to 130 J/g}$$

$$\Delta T\geq 48^\circ \text{ C. for } \Delta H \text{ greater than 130 J/g}$$

wherein the CRYSTAF peak is determined using at least 5 percent of the cumulative polymer, and if less than 5 percent of the polymer has an identifiable CRYSTAF peak, then the CRYSTAF temperature is 30° C.; or (C) elastic recovery, Re, in percent at 300 percent strain and 1 cycle measured with a compression-molded film of the ethylene/α-olefin interpolymer, and has a density, d, in grams/cubic centimeter, wherein the numerical values of Re and d satisfy the following relationship when ethylene/α-olefin interpolymer is substantially free of crosslinked phase:

$$Re>1481-1629(d); \text{ or}$$

(D) has a molecular weight fraction which elutes between 40° C. and 130° C. when fractionated using TREF, characterized in that the fraction has a molar comonomer content of at least 5 percent higher than that of a comparable random ethylene interpolymer fraction eluting between the same temperatures, wherein said comparable random ethylene interpolymer has the same comonomer(s) and has a melt index, density and molar comonomer content (based on the whole polymer) within 10 percent of that of the ethylene/α-olefin interpolymer; or (E) has a storage modulus at 25° C., G'(25° C.), and a storage modulus at 100° C., 0100° C.), wherein the ratio of G'(25° C.) to G'(100° C.) is in the range of about 1:1 to about 9:1.

The ethylene/α-olefin multi-block copolymer may also have:

(F) molecular fraction which elutes between 40° C. and 130° C. when fractionated using TREF, characterized in that the fraction has a block index of at least 0.5 and up to about 1 and a molecular weight distribution, Mw/Mn, greater than about 1.3; or (G) average block index greater than zero and up to about 1.0 and a molecular weight distribution, Mw/Mn greater than about 1.3.

Suitable monomers for use in preparing the present ethylene/α-olefin multi-block copolymer include ethylene and one or more addition polymerizable monomers other than ethylene. Examples of suitable comonomers include straight-chain or branched α-olefins of 3 to 30, or 3 to 20, or 4 to 8 carbon atoms, such as propylene, 1-butene, 1-pentene, 3-methyl-l-butene, 1-hexene, 4-methyl-1-pentene, 3-methyl-1-pentene, 1-octene, 1-decene, 1-dodecene, 1-tetradecene, 1-hexadecene, 1-octadecene and 1-eicosene; cyclo-olefins of 3 to 30, or 3 to 20, carbon atoms, such as cyclopentene, cycloheptene, norbornene, 5-methyl-2-norbornene, tetracyclododecene, and 2-methyl-1,4,5,8-dimethano-1,2,3,4,4a,5,8,8a-octahydronaphthalene; di- and polyolefins, such as butadiene, isoprene, 4-methyl-1,3-pentadiene, 1,3-pentadiene, 1,4-pentadiene, 1,5-hexadiene, 1,4-hexadiene, 1,3-hexadiene, 1,3-octadiene, 1,4-octadiene, 1,5-octadiene, 1,6-octadiene, 1,7-octadiene, ethylidenenorbornene, vinyl norbornene, dicyclopentadiene, 7-methyl-1,6-octadiene, 4-ethylidene-8-methyl-1,7-nonadiene, and 5,9-dimethyl-1,4,8-decatriene; and 3-phenylpropene, 4-phenylpropene, 1,2-difluoroethylene, tetrafluoroethylene, and 3,3,3-trifluoro-1-propene.

In an embodiment, the ethylene/α-olefin multi-block copolymer is void of styrene (i.e., is styrene-free).

The ethylene/α-olefin multi-block copolymer can be produced via a chain shuttling process such as described in U.S. Pat. No. 7,858,706, which is herein incorporated by reference. In particular, suitable chain shuttling agents and related information are listed in Col. 16, line 39 through Col. 19, line 44. Suitable catalysts are described in Col. 19, line 45 through Col. 46, line 19 and suitable co-catalysts in Col. 46, line 20 through Col. 51 line 28. The process is described throughout the document, but particularly in Col. Col 51, line 29 through Col. 54, line 56. The process is also described, for example, in the following: U.S. Pat. No. 7,608,668; U.S. Pat. No. 7,893,166; and U.S. Pat. No. 7,947,793.

In an embodiment, the ethylene/α-olefin multi-block copolymer has hard segments and soft segments, is styrene-free, consists of only (i) ethylene and (ii) a $C_4$-$C_8$ α-olefin comonomer, and is defined as having:

a Mw/Mn from 1.7 to 3.5, at least one melting point, Tm, in degrees Celsius, and a density, d, in grams/cubic centimeter, where in the numerical values of Tm and d correspond to the relationship:

$$Tm<-2002.9+4538.5(d)-2422.2(d)^2,$$

where d is from 0.86 g/cc, or 0.87 g/cc, or 0.88 g/cc to 0.89 g/cc;

and

Tm is from 80° C., or 85° C., or 90° C. to 95, or 99° C., or 100° C., or

105° C. to 110° C., or 115° C., or 120° C., or 125° C.

In an embodiment, the ethylene/α-olefin multi-block copolymer is an ethylene/octene multi-block copolymer and has one, some, any combination of, or all the properties (i)-(ix) below:

(i) a melt temperature (Tm) from 80° C., or 85° C., or 90° C. to 95, or 99° C., or 100° C., or 105° C. to 110° C., or 115° C., or 120° C., or 125° C.;

(ii) a density from 0.86 g/cc, or 0.87 g/cc, or 0.88 g/cc to 0.89 g/cc;

(iii) 50-85 wt % soft segment and 40-15 wt % hard segment;

(iv) from 10 mol %, or 13 mol %, or 14 mol %, or 15 mol % to 16 mol %, or 17 mol %, or 18 mol %, or 19 mol %, or 20 mol % octene in the soft segment;

(v) from 0.5 mol %, or 1.0 mol %, or 2.0 mol %, or 3.0 mol % to 4.0 mol %, or 5 mol %, or 6 mol %, or 7 mol %, or 9 mol % octene in the hard segment;

(vi) a melt index (MI) from 1 g/10 min, or 2 g/10 min, or 5 g/10 min, or 7 g/10 min to 10 g/10 min, or 15 g/10 min to 20 g/10 min;

(vii) a Shore A hardness from 65, or 70, or 71, or 72 to 73, or 74, or 75, or 77, or 79, or 80;

(viii) an elastic recovery (Re) from 50%, or 60% to 70%, or 80%, or 90%, at 300% $min^{-1}$ deformation rate at 21° C. as measured in accordance with ASTM D 1708.

(ix) a polydisperse distribution of blocks and a polydisperse distribution of block sizes.

In an embodiment, the ethylene/α-olefin multi-block copolymer is an ethylene/octene multi-block copolymer.

The present ethylene/α-olefin multi-block copolymer may comprise two or more embodiments disclosed herein.

In an embodiment, the ethylene/octene multi-block copolymer is sold under the Tradename INFUSE™ is available from The Dow Chemical Company, Midland, Mich., USA. In a further embodiment, the ethylene/octene multi-block copolymer is INFUSE™ 9817.

In an embodiment, the ethylene/octene multi-block copolymer is INFUSE™ 9807.

In an embodiment, the ethylene/octene multi-block copolymer is INFUSE™ 9500.

In an embodiment, the ethylene/octene multi-block copolymer is INFUSE™ 9507.

4. Polymeric Blend

In an embodiment, the pop-up spout 24 is composed of a polymeric blend composed of the ethylene/α-olefin multi-block copolymer and a high density polyethylene. A "high density polyethylene" (or "HDPE") is an ethylene homopolymer or an ethylene/α-olefin copolymer with at least one $C_3$-$C_{10}$ α-olefin comonomer, and a density from greater than 0.94 g/cc, or 0.945 g/cc, or 0.95 g/cc, or 0.955 g/cc, or 0.96 g/cc to 0.97 g/cc, or 0.98 g/cc. Nonlimiting examples of suitable comonomers include propylene, 1-butene, 1 pentene, 4-methyl-1-pentene, 1-hexene, and 1-octene. The HDPE includes at least 50 percent by weight units derived from ethylene, i.e., polymerized ethylene, or at least 70 percent by weight, or at least 80 percent by weight, or at least 85 percent by weight, or at least 90 weight percent, or at least 95 percent by weight ethylene in polymerized form. The HDPE can be a monomodal copolymer or a multimodal copolymer. A "monomodal ethylene copolymer" is an ethylene/$C_4$-$C_{10}$ α-olefin copolymer that has one distinct peak in a gel permeation chromatography (GPC) showing the molecular weight distribution. A "multimodal ethylene copolymer" is an ethylene/$C_4$-$C_{10}$ α-olefin copolymer that has at least two distinct peaks in a GPC showing the molecular weight distribution. Multimodal includes copolymer having two peaks (bimodal) as well as copolymer having more than two peaks.

In an embodiment, the HDPE has one, some, or all of the following properties: and has one, some, any combination of, or all the properties (i)-(iv) below:

(i) a density from 0.945 g/cc, or 0.95 g/cc, or 0.955 g/cc, or 0.960 g/cc to 0.965 g/cc, or 0.970 g/cc, or 0.975 g/cc, or 0.980 g/cc; and/or (ii) a melt index (MI) from 0.5 g/10 min, or 1.0 g/10 min, or 1.5 g/10 min, or 2.0 g/10 mil to 2.5 g/10 min, or 3.0; and/or (iii) a melt temperature (Tm) from 125° C., or 128° C., or 130° C. to 132° C., or 135° C., or 137° C.; and/or (iv) a bimodal molecular weight distribution.

In an embodiment, the HDPE has a density from 0.955 g/cc, or 0.957 g/cc, or 0.959 g/cc to 0.960 g/cc, or 0.963 g/cc, or 0.965 g/cc and has a melt index from 1.0 g/10 min, or 1.5 g/10 min, or 2.0 g/10 min to 2.5 g/10 min, or 3.0 g/10 min.

Nonlimiting examples of suitable, commercially available HDPE include but are not limited to Dow High Density Polyethylene resins sold under the trade names CONTINUUM™ and UNIVAL™.

HDPE is distinct from each of the following types of ethylene-based polymer: linear low density polyethylene (LLDPE), metallocence LLDPE (m-LLDPE), ultra low density polyethylene (ULDPE), very low density polyethylene (VLDPE), multi-component ethylene-based copolymer (EPE), ethylene-α-olefin multi-block copolymer, ethylene plastomers/elastomers, and low density polyethylene (LDPE).

The polymeric blend of ethylene/α-olefin multi-block copolymer and HDPE includes from greater than 70 wt %, or 75 wt %, or 80 wt %, or 85 wt % to 90 wt %, or 95 wt %, or 99 wt % of the ethylene/α-olefin multi-block copolymer and a reciprocal amount of HDPE or from less than 30 wt %, or 25 wt %, or 20 wt %, or 15 wt % to 10 wt %, or 5 wt %, or 1 wt % HDPE.

In an embodiment, the entire pop-up spout is composed of only the ethylene/α-olefin multi-block copolymer and HDPE polymeric blend which includes from 75 wt % to 78 wt %, or 80 wt %, or 83 wt %, or 85 wt %, or 87 wt %, or 90 wt % of the ethylene/α-olefin multi-block copolymer and a reciprocal amount of HDPE or from 25 wt % to 22 wt %, or 20 wt %, or 17 wt %, or 15 wt %, or 13 wt %, or 10 wt % of the HDPE and the polymeric blend has one, some, or all of the following properties:

(i) Shore A hardness (Shore D hardness in parentheses) from 80 (29), or 83 (31), or 85 (33), or 87 (35), or 89 (38), or 90 (39), or 91 (40), or 93 (44), or 95 (46), or 97 (50), or 99 (56), or 100 (59); and/or (ii) an elongation at break from 180%, or 200%, or 220%, or 240%, or 260%, or 280%, or 300%, or 320% to 340%, or 360%, or 380%, or 400%, or 410%; and/or (iii) a tensile modulus from 50 MPa, or 75 MPa, or 100 MPa, or 125 MPa, or 150 MPa, or 175 MPa, or 200 MPa to 225 MPa, or 250 MPa, or 275 MPa; and/or (iv) an elastic recovery from 30%, or 35%, or 40%, or 45% to 50%, or 55%, or 60%, or 65%, or 70%.

Nonlimiting examples of ethylene/α-olefin multi-block copolymer and HDPE polymeric blends for the pop-up spout and related properties are set forth in Table 1 below.

TABLE 1

Polymeric blends with ethylene/α-olefin multi-block copolymer and varying amounts of HDPE

| Wt % HDPE in Blend with ethylene/ α-olefin multi-block copolymer | Elongation at Break, % ASTM D638 Tensile Type IV specimens tested at 20 inch/min | Tensile Modulus (MPa) | Hardness, Shore A ASTM D2240 | Elastic recovery ASTM D1708 (300%/min deformation) |
|---|---|---|---|---|
| 0 (100)* | 828 | 17.7 | 76.2 | 62.8 |
| 10 (90) | 406 | 56.6 | 87.7 | 44.0 |
| 15 (85) | 382 | 70.0 | 88.4 | 40.4 |
| 20 (80) | 357 | 94.2 | 89.6 | 36.3 |
| 25 (75) | 307 | 119 | 92.4 | — |
| 30 (70) | 246 | 145 | 93.7 | — |

TABLE 1-continued

Polymeric blends with ethylene/α-olefin multi-block copolymer and varying amounts of HDPE

| Wt % HDPE in Blend with ethylene/ α-olefin multi-block copolymer | Elongation at Break, % ASTM D638 Tensile Type IV specimens tested at 20 inch/min | Tensile Modulus (MPa) | Hardness, Shore A ASTM D2240 | Elastic recovery ASTM D1708 (300%/min deformation) |
|---|---|---|---|---|
| 35 (65) | 188 | 221 | 94.1 | — |
| 40 (60) | 185 | 262 | 94.8 | — |

*Reciprocal amount of ethylene/α-olefin multi-block copolymer in parentheses
ethylene/α-olefin multi-block copolymer—INFUSE 9817
HDPE = DMDC-1250 NT 7

5. Flexible Valve

Figure 5:
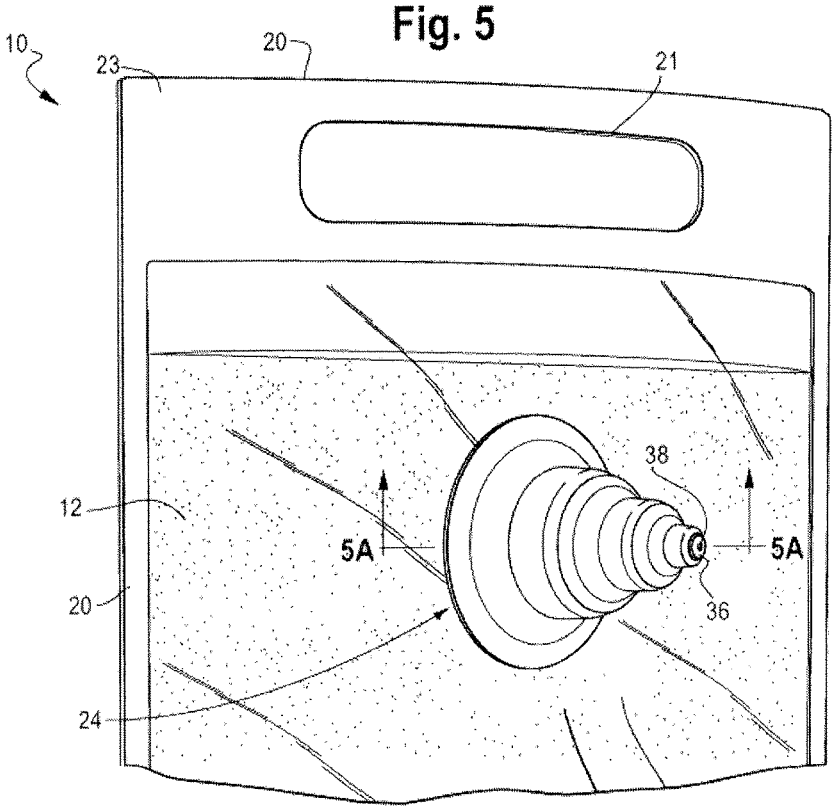
FIG. 5 is a perspective view of the pop-up spout in the extended state, in accordance with an embodiment of the present disclosure.
Figure 5A:
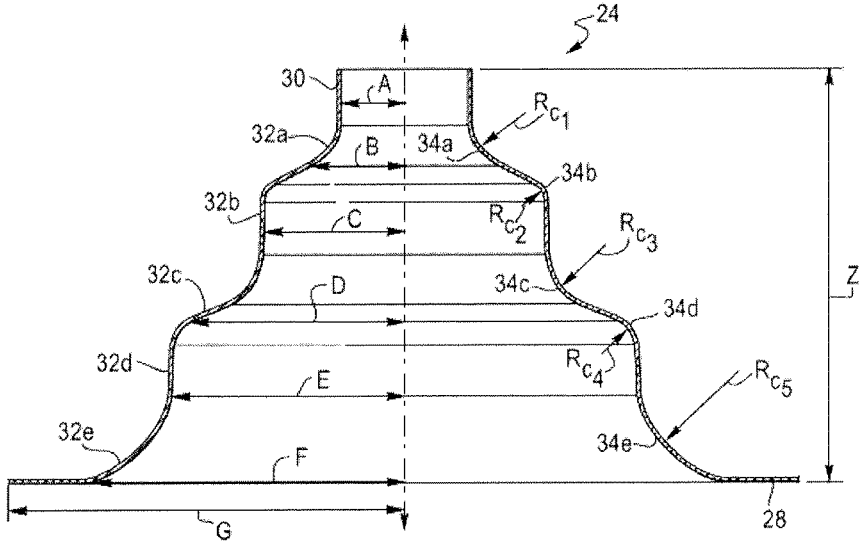
FIG. 5A is a sectional view taken along line 5A-5A of FIG. 5 of the pop-up spout in the extended state, in accordance with an embodiment of the present disclosure.
Figure 6:
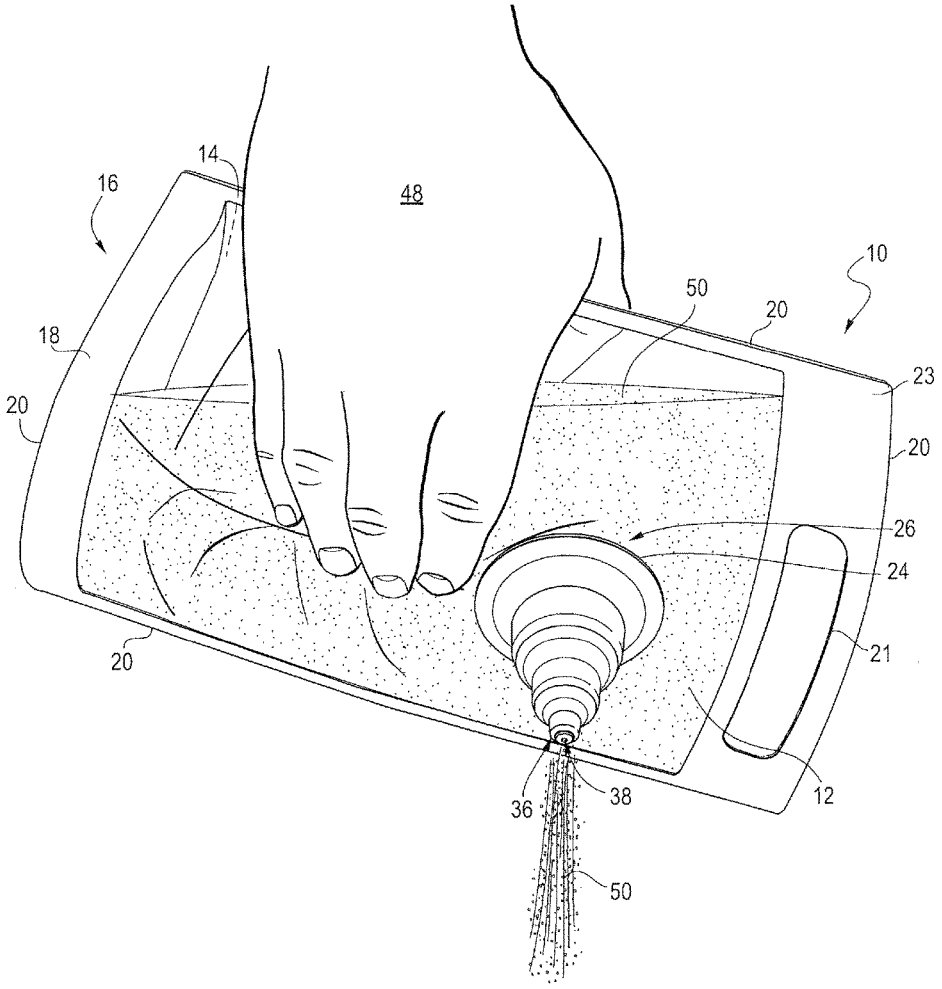
FIG. 6 is a perspective view of a flowable material being dispensed through the pop-up spout in accordance with an embodiment of the present disclosure.

In an embodiment, the pop-up spout 24 includes a flexible valve 36 as shown in FIGS. 5 and 6. The flexible valve 36 is located in the outlet 30.

The flexible valve 36 controls the flow of a flowable material through the channel 26. The shape of the flexible valve 36 can be flat, convex, or concave. The flexible valve 36 has a thickness from 0.1 mm, or 0.2 mm, or 0.3 mm, or 0.4 mm, or 0.5 mm to 0.6 mm, or 0.7 mm, or 0.8 mm, or 0.9 mm, or less the 1.0 mm, or 1.0 mm.

The flexible valve 36 includes an opening 38 which opens to permit flow therethrough. In an embodiment, the flexible valve 36 is integral to the pop-up spout 24 and the flexible valve 36 is composed of, or otherwise is formed from, the same blend of ethylene/α-olefin multi-block copolymer and optional HDPE as the other pop-up spout components.

6. Seal Film

Figure 2:
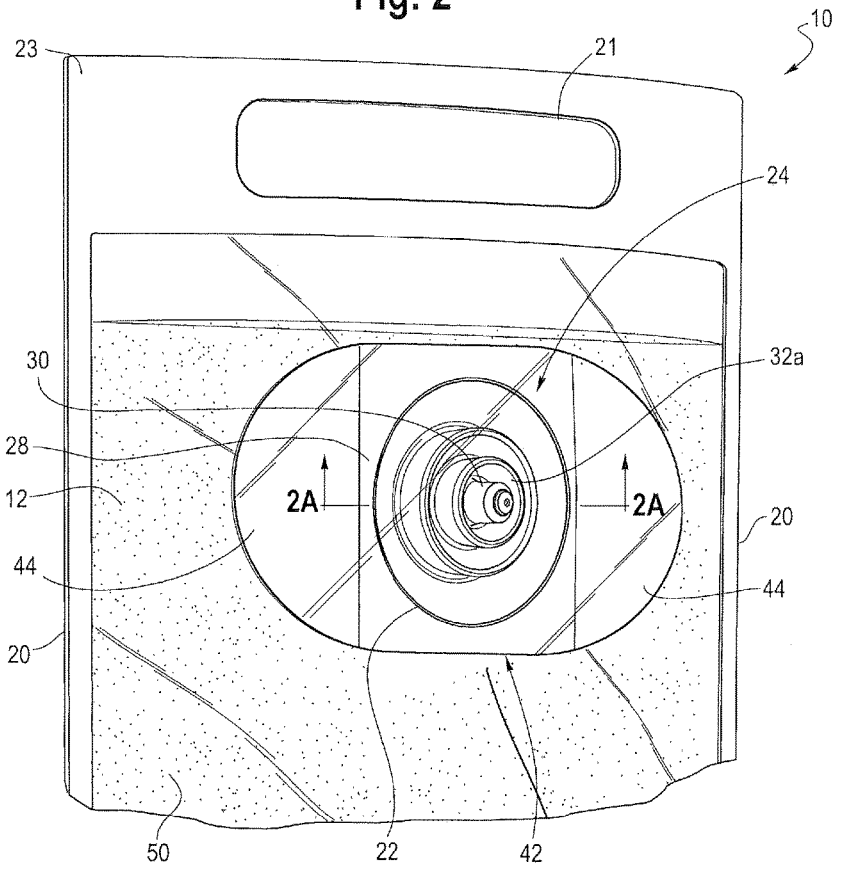
FIG. 2 is a perspective view of the pop-up spout of FIG. 1, the pop-up in a retracted state.
Figure 2A:
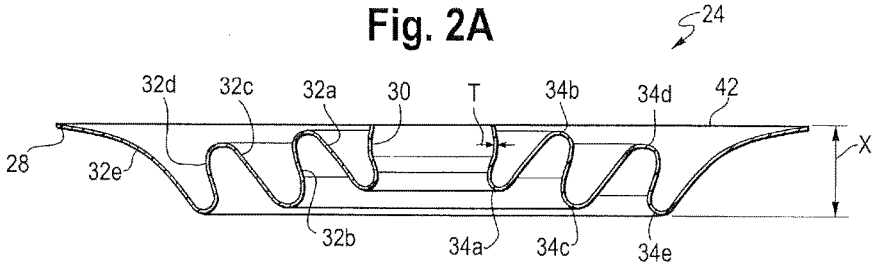
FIG. 2A is a sectional view taken along line 2A-2A of FIG. 2 of the pop-up spout in the retracted state, in accordance with an embodiment of the present disclosure.
Figure 3:
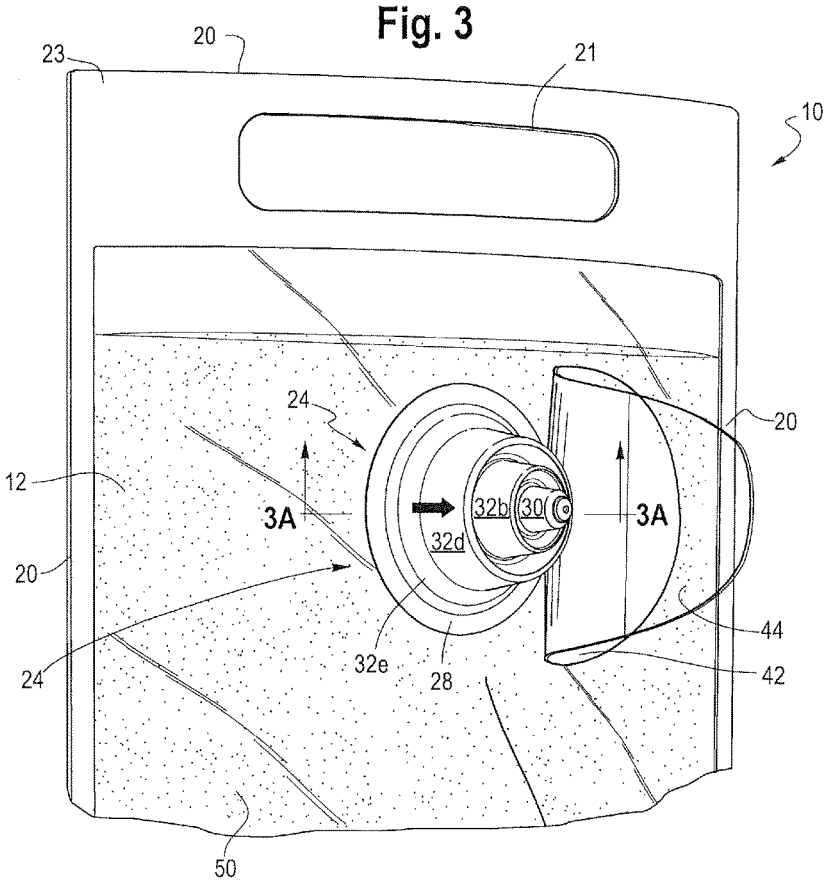
FIG. 3 is a perspective view of the pop-up spout of FIG. 1, the pop-up spout in a neutral state, in accordance with an embodiment of the present disclosure.
Figure 3A:
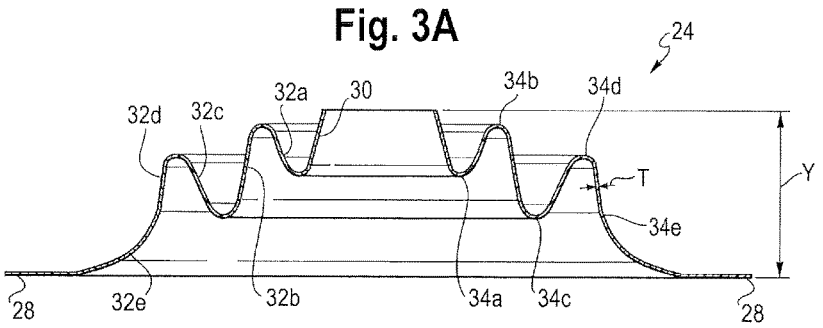
FIG. 3A is a sectional view taken along line 3A-3A of FIG. 3 of the pop-up spout in the neutral state, in accordance with an embodiment of the present disclosure.

In an embodiment, the flexible container 10 includes a seal film 42 as shown in FIGS. 1, 2, and 3. The seal film 42 is a flexible film and covers the pop-up spout 24 when the pop-up spout 24 is in the retracted state X, shown in FIG. 2A. The seal film 42 serves as a restraining member to maintain the pop-up spout 24 in the retracted state X. The seal film 42 is an olefin-based polymer film and includes an inner surface with adhesive material applied thereto. When in the retracted state X, the pop-up spout 24 has an outermost surface that abuts, or otherwise impinges upon, the inner surface of the flexible film 42. The inner surface of the seal film 42 adhesively attaches to at least the flange 28 and optionally may be applied to other areas of the inner surface in order to contact the outlet 30 and/or one or more of the retracted flexible elbows. In this way, the seal film 42 covers all, or substantially all, of the pop-up spout 24 prior to use and protects the pop-up spout 24 from, dirt, contaminants, and other foreign objects until the flexible container 10 is ready for use. Seal film 42 also prevents accidental leakage of the pop-up spout and can be a closure.

In an embodiment, the seal film 42 is composed of an LLDPE with an adhesive material applied to an inner surface thereof. A nonlimiting example of a suitable LLDPE for the seal film 42 is Dowlex 2049, available from The Dow Chemical Company.

In an embodiment, the seal film 42 is a PSA film.

In an embodiment, the seal film 42 includes a tab 44 shown in FIGS. 1, 2, and 3. In this embodiment, the seal film 42 is a pressure sensitive adhesive peel seal film. Tab 44 is an area on the seal film inner surface that is void of adhesive material. As shown in FIG. 3, pulling, or otherwise peeling, the tab 44 away from the flexible container 10 exposes the pop-up spout 24 thereby freeing the pop-up spout from restraint by the seal film 42. Hence, the term "pop-up spout," as used herein, is an extendable spout that naturally, or otherwise automatically, moves from the retracted state to a neutral state upon removal of a restraining member (such as the seal film, for example) located across the retracted pop-up spout.

Applicant discovered that (1) molding, or otherwise injection molding, the pop-up spout 24 in the neutral state and/or (2) utilization of the 75-90 wt % ethylene/α-olefin and 25-10 wt % HDPE blend as the polymeric material for the pop-up spout 24 advantageously imparts an innate extension feature for at least one of the flexible elbows 34*a*-34*e*. The elastic recovery of the ethylene/α-olefin and HDPE polymeric blend in combination with the in-mold formation of the pop-up spout 24 creates an outward compressive force (or pushing force) for the automatic extension of at least one flexible elbow 34*a*-34*e* from the retracted state to the neutral state upon removal of the seal film 42. The tendency and speed for automatic pop-up can be tailored by varying the amount of HDPE blended with the ethylene/α-olefin multi-block copolymer. The present pop-up spout 24 provides a user ready-access to the outlet 30 when the pop-up spout is in the neutral state Y. In the neutral state Y, the outlet 30 is raised above the flange 28, enabling a person to readily pinch or grasp and pull the outlet 30 for full extension of the pop-up spout 24. The configuration and operation of the present pop-up spout 24 is advantageous compared to conventional designs that require additional pull-rings or handles to actuate extension of a spout. In addition, molding the pop-up spout in the neutral state improves the durability of the pop-up spout by minimizing the stress and permanent deformation to the flexible elbows.

In the retracted state X, all the flexible elbows 34*a*-34*e* are in a retracted state. A restraining member (such as the sealing film) is required to hold, or otherwise maintain, the pop-up spout in the retracted state X. In the "neutral state" (or "neutral state Y"), shown in FIG. 3A, at least one, but not all, of the flexible elbows 34-34*e* are in a partially extended, or in a fully extended state. Similarly, in the neutral state, at least one, but not all, of the flexible elbows 34*a*-34*e* are in a retracted state. In the neutral state Y, one or more, but not all, of the foldable panels extend outward and away from the front multilayer film 12.

Figure 4:
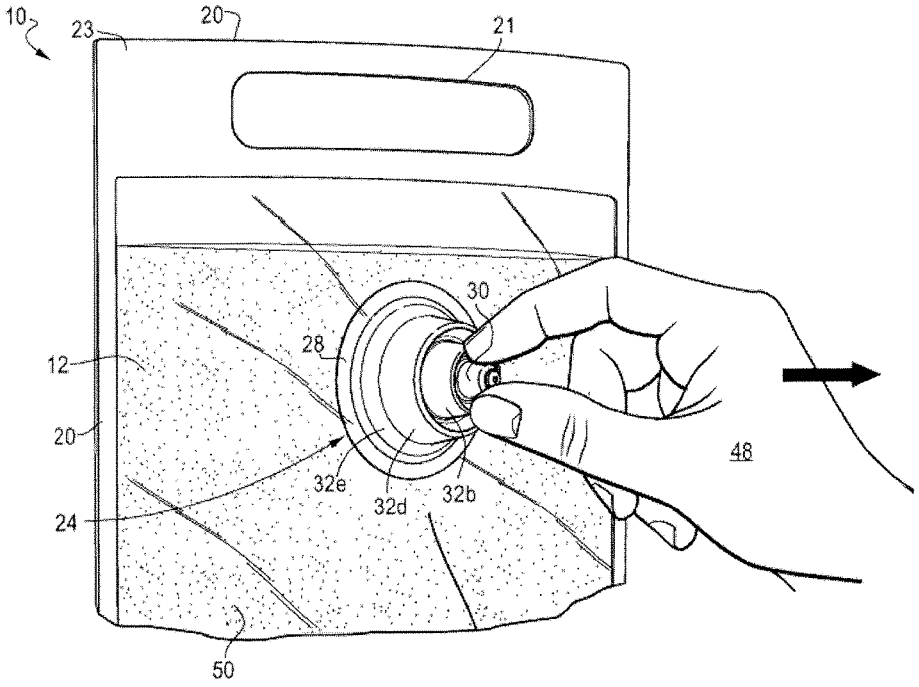
FIG. 4 is a perspective view of a person moving the pop-up spout in the neutral state of FIG. 3 to an extended state, in accordance with an embodiment of the present disclosure.

The present pop-up spout 24 has sufficient innate compressive force (or pushing force) to move naturally (or automatically) from the retracted state X (FIG. 2A) to the neutral state Y (FIG. 3A). FIG. 3A shows an embodiment of the neutral state Y whereby flexible elbow 34*e* is fully extended and flexible elbows 34*a*, 34*b*, 34*c*, and 34*d* are partially extended. In the neutral state Y, the outlet 30 is raised above the partially extended flexible elbows, thereby enabling the outlet 30 to be readily grasped between two fingers of a person's hand, as shown in FIG. 4.

From the neutral state Y, when the outlet 30 is pulled by a user, the pulling force fully extends flexible elbows 34*a*, 34*b*, 34*c*, and 34*d* and lifts the outlet 30 from the neutral state Y to an extended state Z. The "extended state" (or the "extended state Z") is the configuration whereby each flexible elbow 34*a*-34*e* is fully extended. FIGS. 5 and 5A show each flexible elbow 34*a*-34*e* fully extended thereby depicting the extended state Z. In the extended state Z, all of the foldable panels 32*a*-32*e* are unfolded. Once the pop-up spout 24 is in the extended state Z, the flexible container 10 is ready for use.

In the extended state Z, each flexible elbow yields a respective radius of curvature, $R_C$. Nonlimiting examples for radius of curvature values for each of flexible elbow 34*a*-34*e* are provided in Table 2 below.

TABLE 2

| Flexible Elbow | Radius of Curvature ($R_C$) | Range (mm) |
|---|---|---|
| 34a | $R_{C1}$ | 3.5, or 3.7, or 3.9, or 4.0, or 4.3, or 4.5, or 4.7 to 5.0, or 5.5, or 5.6 |
| 34b | $R_{C2}$ | 1.3, or 1.5 to 1.7, or 1.9, or 2.0 |
| 34c | $R_{C3}$ | 4.0, or 4.2, or 4.4, or 4.6 to 4.8, or 5.0, or 5.2, or 5.5 |
| 34d | $R_{C4}$ | 2.2, or 2.5, or 2.7, or 2.9, or 3.0 to 3.1, or 3.2, or 3.3 |
| 34e | $R_{C5}$ | 5.3, or 5.5, or 5.7, or 5.9, or 6.0 to 6.3, or 6.5, or 6.6, or 7.0, or 7.5, or 8.0 |

The magnitude for each radius of curvature ($R_{C1}$-$R_{C5}$), may be the same or different. In an embodiment, at least two, or at least 3 radii of curvature have different values with respect to each other.

In an embodiment, a squeezing force applied to the flexible container 10 by a person's hand 48 is sufficient to dispense a flowable material 50 from the interior of the flexible container as shown in FIG. 6.

In an embodiment, the length of the pop-up spout 24 in the extended configuration Z (FIG. 5A) is from 20 mm, or 40 mm, or 60 mm, or 80 mm, or 100 mm to 120 mm, or 140 mm, or 160 mm, or 180 mm, or 200 mm.

7. Closure

In an embodiment, the pop-up spout 24 may include a closure. The outlet 30 may include threads or other structure to receive a closure. The closure is configured for mated engagement with the outlet 30. Nonlimiting examples of suitable closures, include, screw cap, flip-top cap, snap cap, tamper evident pour spout, vertical twist cap, horizontal twist cap, aseptic cap, vitop press, press tap, push on tap, lever cap, conro fitment connector, and other types of removable (and optionally reclosable) closures.

In an embodiment, the pop-up spout includes a "back plug" closure." The "back-plug closure is affixed in the proximate section of the pop-up spout 24. The back-plug closure fully closes the pop-up spout 24 when the spout is in the retracted state X.

Although FIGS. 1-6 show flexible container 10 as a stand-up pouch, the present flexible container can be a box pouch, pillow pouch, spout k-sealed pouch, spout side gusseted pouch. It is understood that the pop-up spout can be installed on any film surface including front, rear, side, and gusset surfaces of the flexible container.

The present flexible container 10 can be formed with or without handles.

In an embodiment, the flexible container 10 has a volume from 0.05 liter (L), or 0.1 L, or 0.25 L, or 0.5 L, or 0.75 L, or 1.0 L, or 1.5 L, or 2.5 L, or 3 L, or 3.5 L, or 4.0 L, or 4.5 L, or 5.0 L to 6.0 L, or 7.0 L, or 8.0 L, or 9.0 L, or 10.0 L, or 20 L, or 30 L.

8. Flexible Container

Figure 7:
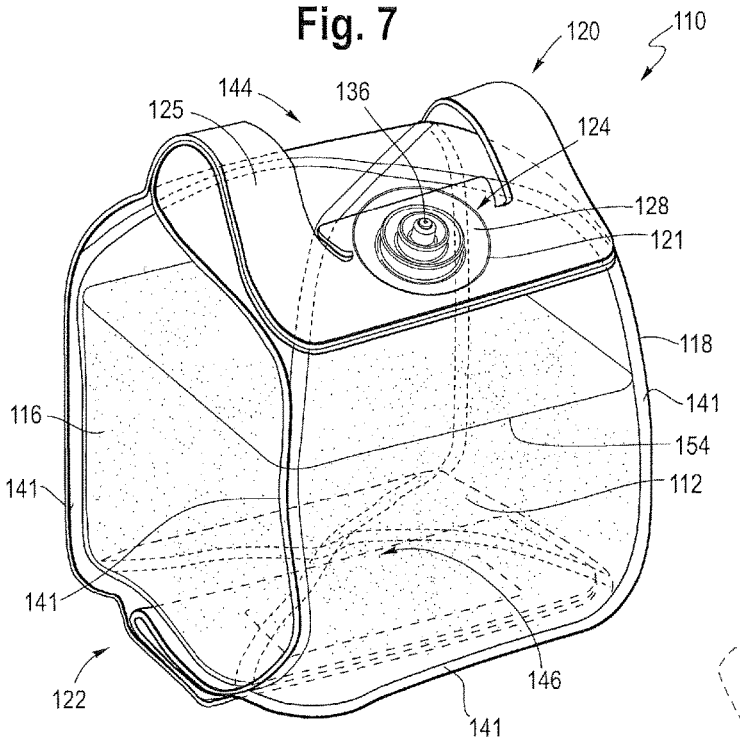
FIG. 7 is a perspective view of another flexible container with a pop-up spout in accordance with an embodiment of the present disclosure.
Figure 8:
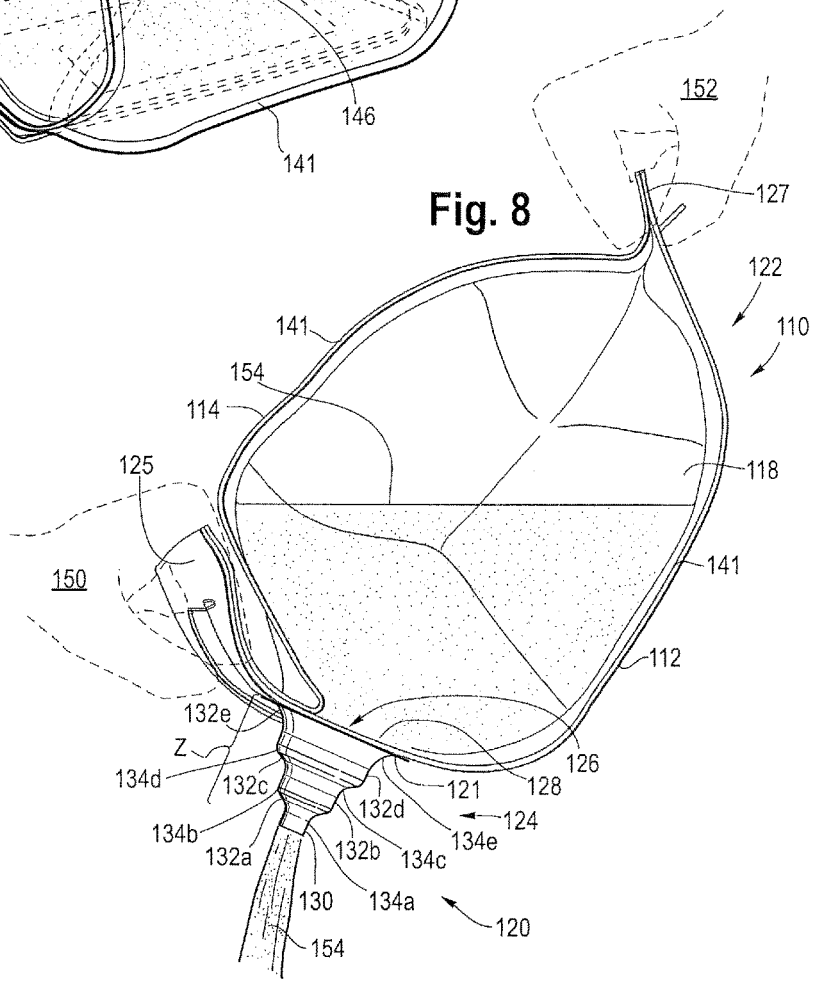
FIG. 8 is an elevation view of the flexible container of FIG. 7 showing the dispensing of a flowable material through the pop-up spout in accordance with an embodiment of the present disclosure.

The present disclosure provides another flexible container. In an embodiment, a flexible container 110 is provided as shown in FIGS. 7-8. The flexible container 110 has four panels, a front panel 112, a back panel 114, a first gusset panel 116 and a second gusset panel 118. The four panels 112, 114, 116, 118, form the top segment 120 and bottom segment 122, respectively. The gusset panels 116, 118 oppose each other. The gusset panels 116, 118 fold inward when the flexible container 110 is in an empty, or a fully collapsed configuration. When the container 110 is inverted, the top and bottom positions in relation to the flexible container 110 change. However, for consistency the handle adjacent an pop-up spout 124 will be called the upper handle 125 (or top handle 125) and the opposite handle will be called the lower handle 127 (or bottom handle 127).

The four panels 112, 114, 116, 118 each can be composed of a separate web of flexible multilayer film. The flexible multilayer film can be any flexible multilayer film as previously disclosed herein. The composition and structure for each web of multilayer film can be the same or different. Alternatively, one web of film may also be used to make all four panels and the top and bottom segments. In a further embodiment, two or more webs can be used to make each panel.

In an embodiment, four webs of multilayer film are provided, one web of multilayer film for each respective panel 112, 114, 116, and 118. The structure and composition for each multilayer film for the panels is the same. The front panel 112 is superimposed on the back panel 114, with the gusset panels 116, 118 located between the front panel and the rear panel. The inner seal layers for the panels face each other. The edges of the front panel 112, the rear panel 114, the first gusset panel 116, and second gusset panel 118 are aligned and form a common peripheral edge. The edges of each panel are heat sealed to the adjacent panel to form peripheral seals 141.

To form the top segment 120 and the bottom segment 122, the four panels of the multilayer film converge together at the respective end and are sealed together. For instance, the top segment 120 can be defined by extensions of the panels 112, 114, 116, 118 sealed together at the top end 144. Similarly, the bottom segment 122 can be defined by extensions of the panels 112, 114, 116, 118 sealed together at the bottom end 146. As shown in FIG. 7, the tapered portions of panels 112, 114, 116, 118 at the bottom end 146 provide sufficient support, stability, and structure to enable the flexible container 110 to be a stand-up pouch, or "SUP."

The flexible container 110 includes an orifice 121 in one of the panels in this case, in front panel 112. A pop-up spout 124 extends through the orifice 121. The pop-up spout 124 has a flange 128 sealed to the inner seal layer of the front panel 112 at the orifice 121. Alternatively, the flange 128 may be sealed to the outermost layer of the front film 112 as previously disclosed herein. The pop-up spout 124 is composed of the ethylene/α-olefin multi-block copolymer and optional HDPE as previously disclosed.

The pop-up spout 124 can be any pop-up spout as previously disclosed herein (such as pop-up 24, for example). The pop-up spout 124 includes a channel 126, a flange 128, an outlet 130, foldable panels **132*a*-132*e*, flexible elbows 134*a*-134*e*, and flexible valve 136**.

The flexible container 110 may include a seal film to cover the pop-up spout 124, as previously disclosed herein.

In an embodiment, the seal film may be attached to the underside of the upper handle 125. The seal film may be any seal film as previously disclosed herein. When a user lifts the handle 125, the upward lifting force moves the pop-up spout 124 from the retracted state X to the neutral state Y. The user (person 152, for example) can then grasp the outlet 130 in a pinching manner and pull the pop-up spout 124 to the extended state Z. In other words, lifting the upper handle 125 peels the seal film away, moving the pop-up spout from the retracted state X to the neutral state Y.

In an embodiment, the pop-up spout 124 enables controlled pouring of a flowable material from the flexible container. As shown in FIG. 8, a person can grasp upper handle 125 with one hand 150 and grasp the lower handle 127 with the other hand 152 to invert the flexible container 110 and accurately control the direction of the discharge of the flowable material 154 from the fully extended spout 124.

In an embodiment, the flexible container 110 has a volume from 0.05 liter (L), or 0.1 L, or 0.25 L, or 0.5 L, or 0.75 L, or 1.0 L, or 1.5 L, or 2.5 L, or 3 L, or 3.5 L, or 4.0 L, or 4.5 L, or 5.0 L to 6.0 L, or 7.0 L, or 8.0 L, or 9.0 L, or 10.0 L, or 20 L, or 30 L.

In an embodiment, the flexible container 10 and/or the flexible container 110 is made from 90 wt % to 100 wt % ethylene-based polymer—the multilayer films being composed of flexible multiple layer film with layer materials selected from ethylene-based polymer such as LLDPE, LDPE, HDPE, and combinations thereof, and the fitment 10 composed of ethylene/α-olefin multi-block copolymer. Weight percent is based on total weight of the flexible container (without content). The flexible container made from 90 wt % to 100 wt % ethylene-based polymer is advantageous as it is readily recyclable.

The present flexible container is suitable for storage of flowable substances including, but not limited to, liquid comestibles (such as beverages), oil, paint, grease, chemicals, suspensions of solids in liquid, and solid particulate matter (powders, grains, granular solids). Nonlimiting examples of suitable liquids include liquid personal care products such as shampoo, conditioner, liquid soap, lotion, gel, cream, balm, and sunscreen. Other suitable liquids include household care/cleaning products and automotive care products. Other liquids include liquid food such as condiments (ketchup, mustard, mayonnaise) and baby food.

The present flexible container is suitable for storage of flowable substances with higher viscosity and requiring application of a squeezing force to the container in order to discharge. Nonlimiting examples of such squeezable and flowable substances include grease, butter, margarine, soap, shampoo, animal feed, sauces, and baby food.

By way of example, and not limitation, examples of the present disclosure are provided.

EXAMPLES

Pop-up spouts are injection molded from ethylene/α-olefin multi-block copolymer sold under the tradename Infuse™ 9817 and Infuse™ 9807, available from The Dow Chemical Company alone, or as a blend with HDPE DMDC-1250 NT. The injection molding machine is a lab scale injection molding machine with injection speed of 350 cubic centimeters per second (cc/sec) having the structure and geometry as pop-spout 24 as shown in FIGS. 1-6. Each of the polymeric materials listed in Table 3 below filled the mold completely and produced suitable pop-up spouts with the structure and geometry of the pop-up spout 24 shown in FIGS. 1-6.

TABLE 3

| No. | Fitment material composition | Molding Results using a lab scale injection machine with injection speed limit: 350 cc/second |
|---|---|---|
| 1 | 100% INFUSE ™ 9817 | Parts molded to design dimensions |
| 2 | 100 wt % Infuse ™ 9807 | Parts molded to design dimensions |
| 3 | Infuse ™ 9807 (90 wt %) + HDPE (10 wt %) | Parts molded to design dimensions |
| 4 | Infuse ™ 9807 (85 wt %) + HDPE (15 wt %) | Parts molded to design dimensions |

TABLE 3-continued

| No. | Fitment material composition | Molding Results using a lab scale injection machine with injection speed limit: 350 cc/second |
|---|---|---|
| 5 | Infuse ™ 9807 (80 wt %) + HDPE (20 wt %) | Parts molded to design dimensions |
| 6 | Infuse ™ 9807 (75 wt %) + HDPE (25 wt %) | Parts molded to design dimensions |

Pop-up spouts 1-6 in Table 3 have the same, or substantially the same, structure and geometry as pop-up spout 24 shown in FIGS. 1-6. The dimensions of pop-up spout Examples 1-6 are provided in Table 4 below.

TABLE 4

Dimensions—Pop-up Spout

| Component[&] (FIGS. 2A-2F) | $R_C$ |
|---|---|
| Outlet 30 | — |
| Flexible elbow 34a | 4.66 |
| FP 32a | — |
| Flexible elbow 34b | 1.67 |
| FP 32b | — |
| Flexible elbow 34c | 5.23 |
| FP 32c | — |
| Flexible elbow 34d | 2.74 |
| FP 32d | — |
| Flexible elbow 34e | 6.61 |
| FP 32e | — |
| Flange 28 | — |
| Spout Total Height 32.3 mm (fully extended) | |

+FP = foldable panel

[&]The spout has a uniform thickness of 0.5 mm, so each component in Table 2 has a thickness of 0.5 mm Each pop-up spout, Examples 1-6, is installed onto a pre-made stand-up pouch made with film structure (Film 1) listed in Table 5 below. Film 1 is designed to be a robust film for multiple applications.

TABLE 5

Structure of the 120 micrometer thick film used for Example 1 (Film 1)

| Material | Description | Density (g/cm3) ASTM D792 | Melt Index (g/ 10 min) ASTM D1238 | Melting Point (° C.) DSC | Thickness (microns) |
|---|---|---|---|---|---|
| LLDPE | Dowlex ™ 2049 | 0.926 | 1 | 121 | 20 |
| HDPE | Elite ™ 5960G | 0.962 | 0.85 | 134 | 20 |
| LLDPE | Elite ™ 5400G | 0.916 | 1 | 123 | 19 |
| Adhesive Layer | Polyurethane solvent less adhesive ( ex. Morfree 970/CR137)- | | | | 2 |
| HDPE | Elite ™ 5960G | 0.962 | 0.85 | 134 | 19 |
| HDPE | Elite ™ 5960G | 0.962 | 0.85 | 134 | 20 |
| Heat Seal Layer | Affinity ™ 1146 | 0.899 | 1 | 95 | 20 |
| Total | | | | | 120 |

Procedure to install the pop-up spout:

1. An orifice hole with a 35 mm diameter is opened in the front film with a scalpel.
2. The spout with the outlet closed on the top (spout 2) is positioned in the internal part of the package centralized with the hole and supported by a metal ring with sufficient height to fully enclose the pop-up spout.
3. A small section of a metal pipe of the exact same dimensions as the flange 28 (42 mm external diameter, 32 mm internal diameter) is heated to 130° C. and hand pressed against the external part of the package, i.e., against the package film for 3 to 5 seconds.
4. A seal film is prepared in advance by coating a piece of Film 1 with Robond™ 8915 pressure sensitive adhesive, which is commonly used for removable label applications. The two ends of the seal film are uncoated to form tabs which can be used to easily remove the seal film by hand. The seal film is firmly adhered to the edges of the pop-up spout and the center section.
5. The edge of the outlet is welded to the seal film by pressing by hand against a heated rod at 130° C. for 3 to 5 seconds, to assure proper functionality of the pop-up spout. This operation would not be required in industrial scale operation depending on the chosen configuration of the spout.

Use of the flexible container

The use of the pop-up spout can be seen in sequence of pictures in FIGS. 3-5.

1. The pop-up spout in the retracted state X does not interfere in the overall thickness of the unfilled SUP.
2. The side tabs left uncoated in the seal film can be easily pulled from the flexible container surface by hand.
3. Since the edges of the outlet are welded to the seal film, the entire spout is readily pulled out to its fully extended state Z.

The pop-up feature of the spout is a result of (i) the configuration of the spout during molding and (ii) the presence of ethylene/α-olefin multi-block copolymer in the injection mold material. Formation (molding) of the pop-up spout occurs with the pop-up spout in the neutral state—i.e., between the retracted state and the fully extended state. Molding the spout in this neutral state has at least two advantages. First, molding the spout in the neutral state allows an automatic pop-up of the spout from the fully retracted state to this neutral state after the restraining member (the pressure sensitive adhesive film) is removed. The tendency and speed for automatic pop-up depends on the elasticity and stiffness of the ethylene/α-olefin multi-block copolymer material utilized. The pop-up spout provides users an easy access to the tip for pulling out the pop-up spout compared to conventional designs that require additional pull-rings or handles. Secondly, molding the spout in the neutral state improves the durability of the spout by minimizing the stress and permanent deformation compared to a spout molded in the retracted state or molded in the extended state.

It is specifically intended that the present disclosure not be limited to the embodiments and illustrations contained herein, but include modified forms of those embodiments including portions of the embodiments and combinations of elements of different embodiments as come within the scope of the following claims.

The invention claimed is:

1. A flexible container comprising:

a first multilayer film and a second multilayer film, with the second multilayer film superimposed on the first multilayer film, the first multilayer film and the second multilayer film each comprising an inner seal layer, the multilayer films arranged such that the inner seal layers oppose each other, the multilayer films sealed along a common peripheral edge;

an orifice in one of the multilayer films;

a pop-up spout extending through the orifice and having a flange sealed to the multilayer film around the orifice; and the pop-up spout comprising an ethylene/α-olefin multi-block copolymer consisting of an ethylene monomer and a $C_4$-$C_8$ α-olefin comonomer.

2. The flexible container of claim 1 wherein the pop-up spout comprises an outlet, a plurality of foldable panels, a plurality of flexible elbows integrally connecting the foldable panels to each other; and the foldable panels and the flexible elbows integrally connecting the flange to the outlet.

3. The flexible container of claim 2 wherein the pop-up spout has a retracted state wherein each flexible elbow is retracted; and a seal film adhesively attached over the pop-up spout to hold the pop-up spout in the retracted state.

4. The flexible container of claim 3 wherein the pop-up spout automatically moves to a neutral state when the seal film is removed from the pop-up spout.

5. The flexible container of claim 4 wherein at least one flexible elbow automatically moves from a retracted state to a fully extended state when the seal film is removed from the pop-up spout.

6. The flexible container of claim 3, wherein the foldable panels emerge outward from the flange, and each of the foldable panels has a radius, with the radius becoming smaller with each foldable panel away from the flange, such that the foldable panels nest concentrically within each other when in the retracted state.

7. The flexible container of claim 2 wherein the pop-up spout has an extended state wherein each flexible elbow is fully extended.

8. The flexible container of claim 7 wherein each flexible elbow has a respective radius of curvature (Rc) when the pop-up spout is in the extended state.

9. The flexible container of claim 2 wherein the pop-up spout defines a channel, and the pop-up spout comprises a flexible valve extending across the channel which opens to permit flow therethrough, the flexible valve comprising the ethylene/α-olefin multi-block copolymer.

10. The flexible container of claim 9 wherein the flexible valve is located in the outlet.

11. The flexible container of claim 1 wherein the pop-up spout is composed of a polymeric blend comprising from greater than 75 wt % to 99 wt of the ethylene/α-olefin multi-block copolymer and from less than 25 wt % to 1 wt % of a high density polyethylene.

12. The flexible container of claim 1 wherein the pop-up spout is an injection molded spout.

13. The flexible container of claim 1, wherein the ethylene/α-olefin multi-block copolymer comprises hard segments consisting of greater than 90 weight percent ethylene and less than 10 weight percent comonomer, and soft segments consisting of ethylene and greater than 5 weight percent comonomer.

14. A flexible container comprising:

a front panel and a rear panel, the front panel superimposed on the rear panel;

a first gusset panel and a second gusset panel located between the front panel and the rear panel, each panel composed of a multilayer film and each multilayer film comprising an inner seal layer, the panels heat sealed along a common peripheral edge;

an orifice in one of the panels; and a pop-up spout extending through the orifice and having a flange sealed to the inner seal layer of the panel at the orifice, the pop-up spout comprising an ethylene/α-olefin multi-block copolymer consisting of an ethylene monomer and a $C_4$-$C_8$ α-olefin comonomer.

15. The flexible container of claim 14 wherein the pop-up spout is located in the front panel.

16. The flexible container of claim 14 wherein the pop-up spout is located in a top segment of the flexible container.

17. The flexible container of claim 14 comprising an upper handle.

18. The flexible container of claim 14 comprising a lower handle.

19. The flexible container of claim 14 wherein the pop-up spout is composed of a polymeric blend comprising from greater than 75 wt % to 99 wt % of the ethylene/α-olefin multi-block copolymer and from less than 25 wt % to 1 wt % of a high density polyethylene.

20. The flexible container of claim 14, wherein the pop-up spout further comprise an outlet and a plurality of foldable panels; and a plurality of flexible elbows integrally connects the foldable panels to each other such that the foldable panels emerge outward from the flange, the foldable panels and the flexible elbows integrally connecting the flange to the outlet, and each of the foldable panels having a radius, with the radius becoming smaller with each foldable panel away from the flange, such that the foldable panels nest concentrically within each other when in the retracted state.

* * * * *